US007491131B2

(12) United States Patent
Vinton

(10) Patent No.: US 7,491,131 B2
(45) Date of Patent: Feb. 17, 2009

(54) GOLF PUTTER HEADS

(76) Inventor: Philip G. Vinton, 4138 Rockwood Dr., Lago Vista, TX (US) 78645

( * ) Notice: Subject to any disclaimer, the term of this patent is extended or adjusted under 35 U.S.C. 154(b) by 238 days.

(21) Appl. No.: 11/029,054

(22) Filed: Jan. 4, 2005

(65) Prior Publication Data

US 2006/0148585 A1 Jul. 6, 2006

(51) Int. Cl.
*A63B 69/36* (2006.01)
*A63B 53/04* (2006.01)

(52) U.S. Cl. ..... 473/251; 473/252; 473/335; 473/340; 473/341; 473/338; 473/339

(58) Field of Classification Search ..... 473/244–256, 473/340–341, 334–339, 349, 332; D21/742–746
See application file for complete search history.

(56) References Cited

U.S. PATENT DOCUMENTS

| | | | | | |
|---|---|---|---|---|---|
| 1,756,219 | A | | 4/1930 | Spiker | |
| RE19,178 | E | * | 5/1934 | Spiker | 473/251 |
| 2,503,506 | A | * | 4/1950 | Miller | 473/251 |
| 2,517,245 | A | * | 8/1950 | Scott | 473/339 |
| 2,715,026 | A | * | 8/1955 | Cadman | 473/334 |
| 2,954,231 | A | * | 9/1960 | MacIntyre | 473/251 |
| 3,888,492 | A | | 6/1975 | Cabot | |
| D235,668 | S | | 7/1975 | Swash | |
| D244,303 | S | * | 5/1977 | Cabot | D21/739 |
| D248,050 | S | | 5/1978 | Muehl | |
| 4,655,459 | A | * | 4/1987 | Antonious | 473/338 |
| 4,762,324 | A | * | 8/1988 | Anderson | 473/249 |
| D320,250 | S | * | 9/1991 | Hughes | D21/745 |
| 5,062,638 | A | | 11/1991 | Shira et al. | |
| 5,211,401 | A | * | 5/1993 | Hainey | 473/340 |
| D337,803 | S | | 7/1993 | Sillers | |
| 5,275,413 | A | | 1/1994 | Sprague et al. | |
| 5,344,149 | A | * | 9/1994 | Miller | 473/341 |
| D363,101 | S | * | 10/1995 | Sturm | D21/746 |
| D365,864 | S | | 1/1996 | Sturm | |
| 5,494,282 | A | * | 2/1996 | Pranio | 473/313 |
| 5,690,562 | A | | 11/1997 | Strum et al. | |
| 5,820,481 | A | | 10/1998 | Raudman | |
| 5,830,078 | A | | 11/1998 | McMahan | |

(Continued)

FOREIGN PATENT DOCUMENTS

| | | |
|---|---|---|
| WO | WO 94/27684 | 12/1994 |

(Continued)

OTHER PUBLICATIONS

Bobby Grace Putters, 4 pages printed from http://www.clubmaker-online.com/bobbygrace.html on Dec. 29, 2004.

*Primary Examiner*—Sebastiano Passaniti
(74) *Attorney, Agent, or Firm*—Fulbright & Jaworski L.L.P.

(57) ABSTRACT

Golf putter heads having a front piece and a rear piece that is separate from and connected to the front piece. Embodiments of the golf putter heads include rear pieces having arrowhead shapes. Embodiments of the golf putter heads include rear pieces with removably connectable weights that can be positioned about the perimeter of the rear piece. Golf clubs (e.g., putters) that include one of the present golf putter heads, and methods of treating the strike face of certain of the present golf putter heads.

18 Claims, 11 Drawing Sheets

U.S. PATENT DOCUMENTS

| | | | | |
|---|---|---|---|---|
| 6,001,024 | A * | 12/1999 | Van Alen et al. | 473/244 |
| D437,017 | S | 1/2001 | Ford | |
| 6,264,571 | B1 | 7/2001 | Lekavich | |
| 6,348,014 | B1 | 2/2002 | Chiu | |
| 6,409,610 | B1 | 6/2002 | Ahn et al. | |
| 6,409,613 | B1 | 6/2002 | Sato | |
| D460,990 | S * | 7/2002 | Jung | D21/736 |
| 6,464,599 | B1 * | 10/2002 | Wolf | 473/328 |
| D477,041 | S * | 7/2003 | Cameron | D21/742 |
| 6,638,181 | B1 | 10/2003 | Norman, III | |
| 6,641,487 | B1 | 11/2003 | Hamburger | |
| 6,652,390 | B2 | 11/2003 | Bradford | |
| D483,085 | S | 12/2003 | Mathews, Jr. | |
| D483,824 | S | 12/2003 | Tang et al. | |
| 6,663,497 | B2 | 12/2003 | Cameron | |
| 6,663,502 | B2 | 12/2003 | Nelson et al. | |
| D484,935 | S | 1/2004 | Tang | |
| D485,323 | S | 1/2004 | Wagner et al. | |
| 6,679,781 | B1 * | 1/2004 | Green | 473/226 |
| D486,540 | S | 2/2004 | Bettinardi | |
| D486,541 | S | 2/2004 | Bettinardi | |
| 6,692,378 | B2 | 2/2004 | Shmoldas et al. | |
| 6,699,142 | B2 | 3/2004 | Wu | |
| 6,702,689 | B2 | 3/2004 | Ashton | |
| 6,796,911 | B2 | 9/2004 | Grace | |
| 6,896,625 | B2 * | 5/2005 | Grace | 473/251 |
| D506,796 | S * | 6/2005 | Li | D21/742 |
| D507,613 | S * | 7/2005 | Baiocchi | D21/742 |
| 6,988,955 | B2 * | 1/2006 | Stoakes | 473/242 |
| D515,156 | S * | 2/2006 | Garcia | D21/746 |
| 7,048,646 | B2 * | 5/2006 | Yamanaka et al. | 473/332 |
| 2002/0098912 | A1 | 7/2002 | Anderson et al. | |
| 2003/0157993 | A1 | 8/2003 | Pechter et al. | |
| 2003/0195053 | A1 | 10/2003 | Cameron | |
| 2004/0033842 | A1 | 2/2004 | Collins et al. | |
| 2004/0053703 | A1 | 3/2004 | Snyder | |
| 2004/0063516 | A1 | 4/2004 | Cameron | |
| 2004/0132542 | A1 | 7/2004 | Olsavsky et al. | |
| 2004/0138003 | A1 | 7/2004 | Grace | |
| 2004/0219987 | A1 * | 11/2004 | Scott et al. | 473/200 |
| 2005/0187028 | A1 * | 8/2005 | Chang et al. | 473/231 |
| 2005/0192114 | A1 * | 9/2005 | Zider et al. | 473/251 |
| 2005/0261080 | A1 * | 11/2005 | Bradford | 473/340 |
| 2006/0052178 | A1 * | 3/2006 | Franklin et al. | 473/340 |
| 2006/0172816 | A1 * | 8/2006 | Johnson | 473/334 |

FOREIGN PATENT DOCUMENTS

| | | |
|---|---|---|
| WO | WO 2004/009187 | 1/2004 |
| WO | WO 2005/079933 | 9/2005 |

* cited by examiner

GOLF PUTTER HEADS

BACKGROUND OF THE INVENTION

1. Field of the Invention

The invention relates to golf putter heads, including those that have separate but removably connected front and rear pieces, those that have adjustable weight systems, and/or those that bear two or more arrowhead shapes that point toward the strike face of the putter head. The invention also relates to methods of treating the strike face of golf putter heads. The invention also relates to golf clubs that incorporate any of the present golf putter heads.

2. Description of Related Art

Examples of previous putters include those disclosed in the following patents and applications: U.S. Pat. Nos. 1,756,219, 3,888,492, 5,820,481, 5,830,078, 6,264,571, 6,348,014, 6,409,610, 6,409,613, 6,638,181, 6,641,487, 6,652,390, 6,663,497, 6,663,502, 6,692,378, 6,699,142, 6,702,689 and 6,796,911; U.S. Design Patent Nos. D235,668, D248,050, D337,803, D365,864, D437,017, D477,041, D483,085, D483,824, D484,935, D485,323, D486,540 and D486,541; U.S. Patent Application Publication Nos. 2003/0157993, 2003/0195053, 2004/0033842, 2004/0053703, 2004/0063516 and 2004/0132542; and PCT Application Nos. WO 94/27684 and WO 2004/009187.

SUMMARY OF THE INVENTION

Some embodiments of the present invention comprise golf putter heads that include a front piece having a strike face; and a rear piece that is separate from and connected to the front piece. The rear piece includes two or more arrowhead shapes that point toward the strike face.

In other embodiments: the front piece includes a top surface and a bore extending into the front piece from the top surface at an angle of zero to 10 degrees to the strike face; a rear piece bore extends into the rear piece, the rear piece bore being at least partially aligned with the bore in the front piece and having a smaller diameter than the bore in the front piece; the strike face has a texture achieved by blasting the strike face with material that is number 6 grit in size or smaller; and the rear piece has a mass, and (a) the front piece has a top and a bottom, (b) a plane intersects the strike face substantially mid-way between the top and the bottom and extends into and through the rear piece, and (c) a majority of the mass of the rear piece is positioned above the plane.

In still other embodiments: (a) the rear piece has a rear piece bottom surface, (b) one or more weight recesses extend into the rear piece from the rear piece bottom surface, and (c) a weight is at least partially positioned in one of the one or more weight recesses and removably connected to the rear piece with one or more fasteners; (a) the rear piece has a rear piece top surface, (b) one or more weight recesses extend into the rear piece from the rear piece top surface, and (c) a weight is at least partially positioned in one of the one or more weight recesses and removably connected to the rear piece with one or more fasteners; the two or more arrowhead shapes comprise arrowhead-shaped openings in the rear piece; and the two or more arrowhead shapes comprise at least two arrowhead-shaped openings in the rear piece that are substantially aligned behind, so as to be substantially perpendicular to, the strike face; each arrowhead-shaped opening has an arrowhead angle; and the arrowhead angles of at least two arrowhead-shaped openings decrease in size from a back end of the rear piece toward the strike face.

In still other embodiments: the front piece includes (a) a first recess in which a forward portion of the rear piece is at least partially positioned, and (b) a second recess that is closer to the strike face than the first recess, the second recess being substantially empty; the golf putter heads also include one or more weights that are removably connected to the rear piece; the rear piece has a back end and comprises (a) a forward portion, (b) a central portion extending away from the forward portion, and (c) two rear side arms, each rear side arm extending toward, but terminating prior to, the forward portion at an angle to the central portion; the rear piece has a back end and comprises (a) a forward portion, (b) a central portion extending away from the forward portion, and (c) two rear side arms, each rear side arm being curved and extending into the forward portion; the rear piece has a back end and comprises (a) a forward portion, (b) a central portion extending away from the forward portion, (c) a first set of rear side arms, each rear side arm in the first set extending at an angle from one side of the central portion and away from the forward portion, and (d) a second set of rear side arms, each rear side arm in the second set extending at an angle from another side of the central portion and away from the forward portion; one or more weights are removably connected to at least one of the rear side arms in the first set of rear side arms; and the rear piece has a back end and comprises (a) a forward portion, (b) a central portion extending away from the forward portion, and (c) two rear side arms extending from the central portion and at least partially defining the back end, the two rear side arms giving a rear portion of the rear piece a wedge-like shape.

Some embodiments of the present invention comprise golf putter heads that include a front piece having a strike face, a top surface, and a bottom surface; a rear piece separate from and connected to the front piece, the rear piece having a mass; and a weight removably connected to the rear piece. A plane intersects the strike face substantially mid-way between the top and the bottom and extends into and through the rear piece, and a majority of the mass of the rear piece is positioned above the plane.

In other embodiments: the front piece includes a bore extending into the front piece from the top surface at an angle of zero to 10 degrees to the strike face; a rear piece bore extends into the rear piece, the rear piece bore being at least partially aligned with the bore in the front piece and having a smaller diameter than the bore in the front piece; the strike face has a texture achieved by blasting the strike face with material that is number 6 grit in size or smaller; (a) the rear piece has a rear piece bottom surface, (b) one or more weight recesses extend into the rear piece from the rear piece bottom surface, and (c) the weight is at least partially positioned in one of the one or more weight recesses and removably connected to the rear piece with one or more fasteners; and the rear piece includes two or more weight recesses that extend into the rear piece from the rear piece bottom surface, a first weight is at least partially positioned in one of the weight recesses and removably connected to the rear piece with one or more fasteners, and a second weight is at least partially positioned in another of the weight recesses and removably connected to the rear piece with one or more fasteners.

In still other embodiments: (a) the rear piece has a rear piece top surface, (b) one or more weight recesses extend into the rear piece from the rear piece top surface, and (c) a weight is at least partially positioned in one of the one or more weight recesses and removably connected to the rear piece with one or more fasteners; the rear piece includes two or more weight recesses that extend into the rear piece from the rear piece top surface, a first weight is at least partially positioned in one of the weight recesses and removably connected to the rear piece with one or more fasteners, and a second weight is at least partially positioned in another of the weight recesses and removably connected to the rear piece with one or more fasteners; the two or more arrowhead shapes comprise arrowhead-shaped openings in the rear piece; and the two or more arrowhead shapes comprise at least two arrowhead-shaped openings in the rear piece that are substantially aligned behind, so as to be substantially perpendicular to, the strike face; each arrowhead-shaped opening has an arrowhead angle; and the arrowhead angles of at least two arrowhead-shaped openings decrease in size from a back end of the rear piece toward the strike face.

In still other embodiments: the front piece includes (a) a first recess in which a forward portion of the rear piece is at least partially positioned, and (b) a second recess that is closer to the strike face than the first recess, the second recess being substantially empty; the rear piece has a back end and comprises (a) a forward portion, (b) a central portion extending away from the forward portion, and (c) two rear side arms, each rear side arm extending toward, but terminating prior to, the forward portion at an angle to the central portion; the rear piece has a back end and comprises (a) a forward portion, (b) a central portion extending away from the forward portion, and (c) two rear side arms, each rear side arm being curved and extending into the forward portion; the rear piece has a back end and comprises (a) a forward portion, (b) a central portion extending away from the forward portion, (c) a first set of rear side arms, each rear side arm in the first set extending at an angle from one side of the central portion and away from the forward portion, and (d) a second set of rear side arms, each rear side arm in the second set extending at an angle from another side of the central portion and away from the forward portion; and one or more weights are removably connected to at least one of the rear side arms in the first set of rear side arms.

In still other embodiments, the rear piece has a back end and comprises (a) a forward portion, (b) a central portion extending away from the forward portion, and (c) two rear side arms extending from the central portion and at least partially defining the back end, the two rear side arms giving a rear portion of the rear piece a wedge-like shape.

Some embodiments of the present invention comprise methods of texturing a strike face of a golf putter head that include blasting the strike face with material that is number 6 grit in size or smaller. In some embodiments, the material is aluminum oxide.

Some embodiments of the present invention comprise golf clubs (e.g., putters) that include a shaft and any of the present golf putter heads connected to an end (e.g., the hosel) of the shaft. In some embodiments, one or more grips are also connected to the shaft.

Additional embodiments of the present golf putter heads, methods and golf clubs, and details associated with those embodiments, are described below.

BRIEF DESCRIPTION OF THE DRAWINGS

The following drawings depict different embodiments of the present golf putter heads. The embodiments shown are exemplary; other embodiments that are not shown are possible. Identical reference numerals does not necessarily indicate an identical structure. Rather, the same reference numeral may be used to indicate a similar feature or a feature with similar functionality. The embodiments shown in the drawings are drawn to scale (in terms of proportions) unless otherwise noted. Some features of the illustrated embodiment have not been labeled in all of the drawings (e.g., FIGS. 1 and 2), so that the drawings are not unnecessarily cluttered.

DESCRIPTION OF ILLUSTRATIVE EMBODIMENTS

Figure 1:
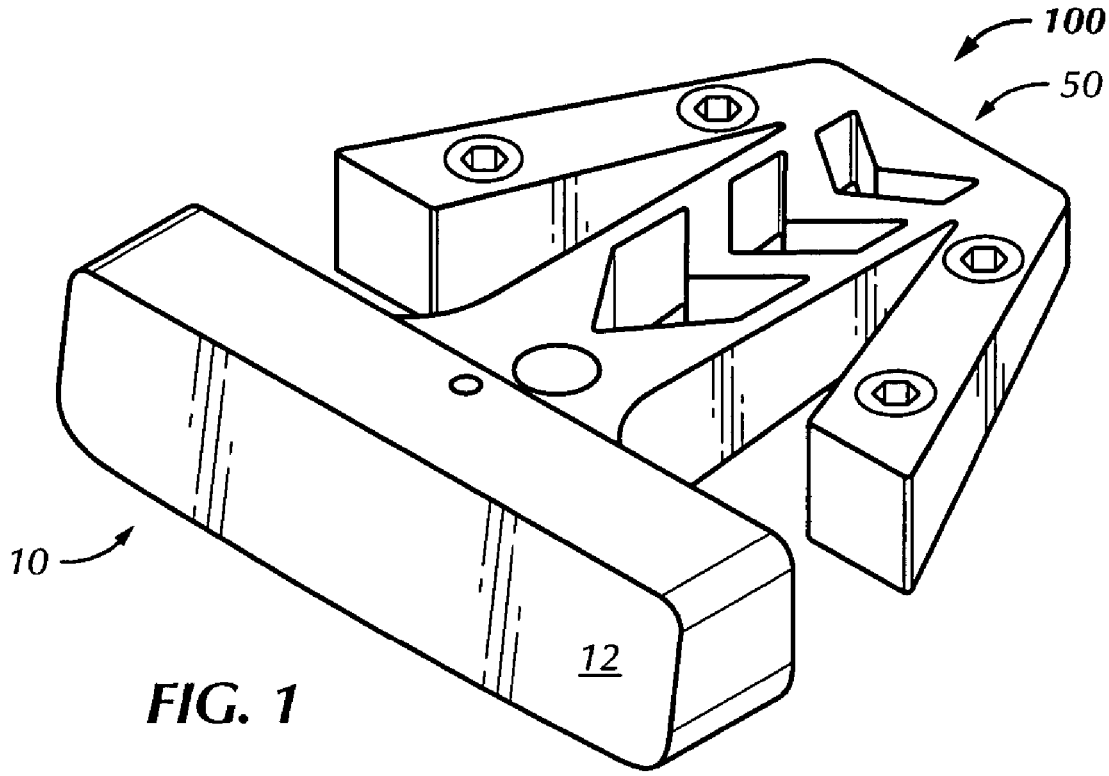
FIG. 1 is a perspective view of the front, top and left side of one embodiment of the present golf putter heads, showing the putter head in an assembled state.

The terms "comprise" (and any form of comprise, such as "comprises" and "comprising"), "have" (and any form of have, such as "has" and "having"), and "include" (and any form of include, such as "includes" and "including") are open-ended linking verbs. As a result, a golf putter head, or a feature of a golf putter head, that "comprises," "has," or "includes" one or more elements possesses those one or more elements, but is not limited to possessing only those one or more elements. It can also possess elements or other features that are not listed. Furthermore, a device or structure that is configured in a certain way is configured in at least that way, but may also be configured in ways that are not listed.

Thus, and by way of example, a golf putter head "comprising" a front piece having a strike face; and a rear piece separate from and connected to the front piece, the rear piece including two or more arrowhead shapes that point toward the strike face, is a golf putter head that has, but is not limited to having only, the recited features. That is, the golf putter head possesses at least the recited features, but does not exclude other features that are not expressly recited.

The terms "a" and "an" are defined as one or more than one unless this disclosure explicitly requires otherwise. The term "substantially" is defined as at least close to (and includes) a given value or state (preferably within 10% of, more preferably within 1% of, and most preferably within 0.1% of). The phrase "removably connected" is defined such that two items that are "removably connected" can be separated from each other without breaking or destroying the utility of either item. Generally, a mechanical fastener such as a screw or bolt can be used to achieve the removable connection. Other suitable fasteners for achieving removable connections include clamps, pins, and clasps. Two items that have been welded together are not removably connected. Separate items that are "connected" to each other can be joined in any suitable fashion, including through the means described above for making removable connections, and further through means such as gluing, adhesively bonding, or welding. Two features that are formed integrally with each other from the same original piece of material are not "connected" to each other as that term is used here.

A. Exemplary Embodiments of the Present Golf Putter Heads

1. FIGS. 1-11

FIGS. 1-11 illustrate one embodiment of the present golf putter heads. Shafts may be connected to all of the present golf putter heads to form the present putters, although shafts are not shown in the figures. Golf putter head 100 includes front piece 10 and rear piece 50, which is separate from and connected (and, in this embodiment, removably connected) to front piece 10 with screws 22. Screws 22, as well as all the screws shown in the figures, may be of any suitable style and size, such as a size M4 or M5 socket flathead cap screw. Alternatively, screws 22 (as well as all screws shown in the figures) can be socket head cap screws, and the screw openings in rear piece 50 or in the weights to be connected to rear piece 50 (discussed in more detail below) can be modified to accept socket head cap screws.

Front piece 10 has a strike face 12. The strike face of a given front piece is the portion of the golf putter head that will traditionally be used by a player to strike a golf ball during most play and practice. Front piece 10 may also be characterized as having a unitary strike face 12, meaning that front piece 10 does not have an insert that serves as a portion or all of strike face 12. By contrast, Odyssey's "White Hot" putters lack a front piece with a unitary strike face because they each have an insert that serves as a portion or all of the strike face of those putters.

Figure 9:
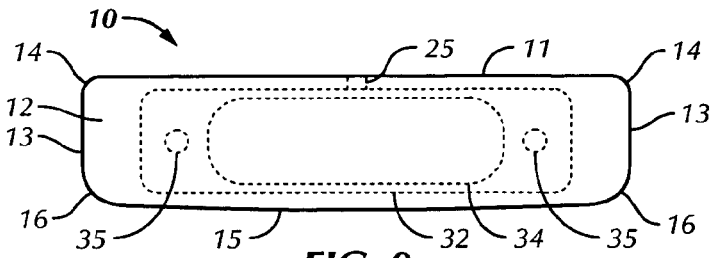
FIG. 9 is a front view showing the strike face of the front piece of the golf putter head shown in FIG. 1, with hidden features (such as the two recesses) depicted in dashed lines.

Front piece 10, which can be used with each of the embodiments of the present putters shown in the figures, has a substantially flat (and, in this embodiment, flat) top surface 11; two side surfaces 13 that are substantially flat (and, in this embodiment, flat), substantially parallel (and, in this embodiment, parallel) to each other, and substantially perpendicular (and, in this embodiment, perpendicular) to the top surface 11; and a bottom surface 15 that is slightly curved (see especially FIG. 9). The top and side surfaces of front piece 10 are connected by two fillets 14, and the bottom and side surfaces are connected by two slightly larger fillets 16. In some embodiments of front piece 10, the distance between side surfaces 13 can be less than or equal to 5 inches. In some embodiments of front piece 10, the distance between side surfaces 13 can be less than or equal to 4 inches. In some embodiments of front piece 10, the distance between side surfaces 13 can be 3.75 inches or less.

Figure 10:
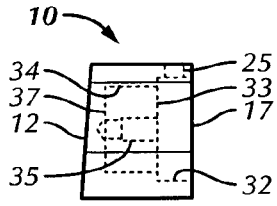
FIG. 10 is a left side view of the front piece of the golf putter head shown in FIG. 1, with hidden features depicted in dashed lines and the right side being a mirror image.

Front piece 10 also includes a rear surface 17 that is substantially perpendicular to the top, side and bottom surfaces of the front piece. Strike face 12 (which also comprises the front surface of front piece 10) can have a loft, as best shown in FIG. 10. Any suitable loft may be used, including the loft illustrated in FIG. 10. Versions of front piece 10 having a strike face with no loft are also possible.

Front piece 10 also includes a bore 25 extending into it from top surface 11. Bore 25 (or, the front piece bore) may be set at any suitable angle relative to the strike face or the rear surface of front piece 10, such as at any angle from −10 degrees to 10 degrees (including any integer, or portion of any integer, within that range) to strike face 12 or rear surface 17. Bore 25 can be substantially centered (and, in this embodiment, centered) between side faces 13 of front piece 10. Furthermore, bore 25 can be located closer to rear surface 17 than to strike face 12. A player can use bore 25 as a site for centering golf putter head 100 relative to the golf ball he or she is about to hit. Some embodiments of the present golf putter heads have no front piece bore. At least one function of the front piece bore (and rear piece bores that are shown) is to help the player position the strike face of the golf putter head beneath (e.g., directly beneath) or slightly ahead of the player's eyes when the player is looking straight down. If the player contacts the golf ball when the arc of the putter path is in the "upswing" portion of the stroke, there should be less bounce of the ball (than if the putter contacted the ball in the "level" or "downswing" portion of the stroke), the therefore a better roll.

Figure 8:
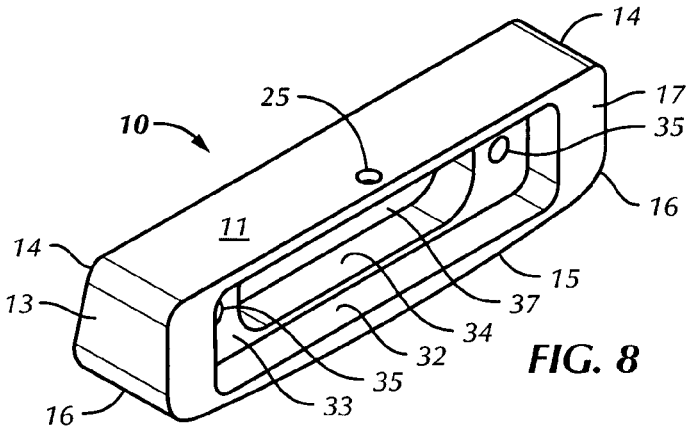
FIG. 8 is a perspective view of the top, back and left side of the front piece of the golf putter head shown in FIG. 1.

As shown in FIG. 8, front piece 10 includes a first recess 32 that extends into front piece 10 from rear surface 17, but which terminates prior to strike face 12. First recess 32 is configured such that forward portion 63 of rear piece 50 can be at least partially positioned in it. First recess 32 can be configured to such that at least a portion of forward portion 63 fits snugly within it. In other words, first recess 32 can be configured such that any gaps between the portions of top surface 51 of rear piece 50, bottom surface 53 of rear piece 50, side faces 71 of rear piece 50 and the side walls that define first recess 32 are small.

Continuing with front piece 10, first recess 32 is defined in part by first recess front wall 33, which as shown in FIG. 10, can be substantially parallel (and, in this embodiment, parallel) to rear surface 17 of front piece 10. Front piece 10 is configured to be connected (and, in this embodiment, removably connected) to rear piece 50 in part because front piece 10 includes one or more fastener (e.g., screw) openings 35 that extend from first recess front wall 33 toward (but not into) strike face 12. Front piece 10 also can include a second recess 34, which as shown in FIGS. 8 and 10, can start at first recess front wall 33 and extend toward (but not into) strike face 12. Second recess 34 can remain substantially empty (and, in this embodiment, empty) when rear piece 50 is connected to front piece 10. Second recess 34 is defined in part by second recess front wall 37, which as shown in FIG. 10, can be substantially parallel (and, in this embodiment, parallel) to rear surface 17 of front piece 10. Second recess 34 can be closer to strike face 12 than first recess 32, as shown in FIGS. 8 and 10. Furthermore, the profile of second recess 34 can be smaller than the profile of first recess 32, as shown in FIGS. 8-10. The embodiment of front piece 10 shown in figures can be characterized as "peripherally weighted" because, for a given section of front piece 10, more mass is located at its periphery.

Rear piece 50 includes two or more arrowhead shapes that point toward strike face 12. More specifically, rear piece 50 includes three arrowhead shapes—52, 54 and 56—which comprise arrowhead-shaped openings extending from top surface 51 of rear piece 50 to bottom surface 53. Arrowhead-shaped openings 52, 54 and 56 are substantially aligned (and, in this embodiment, aligned) behind, so as to be substantially perpendicular (and, in this embodiment, perpendicular) to, strike face 12 (and, in this embodiment, front face 69 of forward portion 63 of rear piece 50, which is discussed below in greater detail), as shown most clearly in FIGS. 4 and 5. Arrowhead-shaped openings 52, 54 and 56 also can be characterized as being substantially aligned behind strike face 12 and/or front face 69 in series with each other.

Each arrowhead-shaped opening includes a leading pair of edges that meet to form an arrowhead angle. Thus, arrowhead-shaped opening 52 includes an arrowhead angle 52A, arrowhead-shaped opening 54 includes an arrowhead angle 54A, and arrowhead-shaped opening 56 includes an arrowhead angle 56A. Each arrowhead angle is constant (meaning the edges forming the angle are not curved).

The size of each successive arrowhead angle decreases from back end 61 toward front portion 63 and strike face 12, as arrowhead angle 52A is less than arrowhead angle 54A, which is less than arrowhead angle 56A. Thus, the arrowhead angles shown in FIG. 4 are an example of at least two arrowhead angles of two or more arrowhead-shaped openings that decrease in size from the back end of a rear piece toward the strike face of the front piece, or the forward portion of the rear piece.

Figure 4:
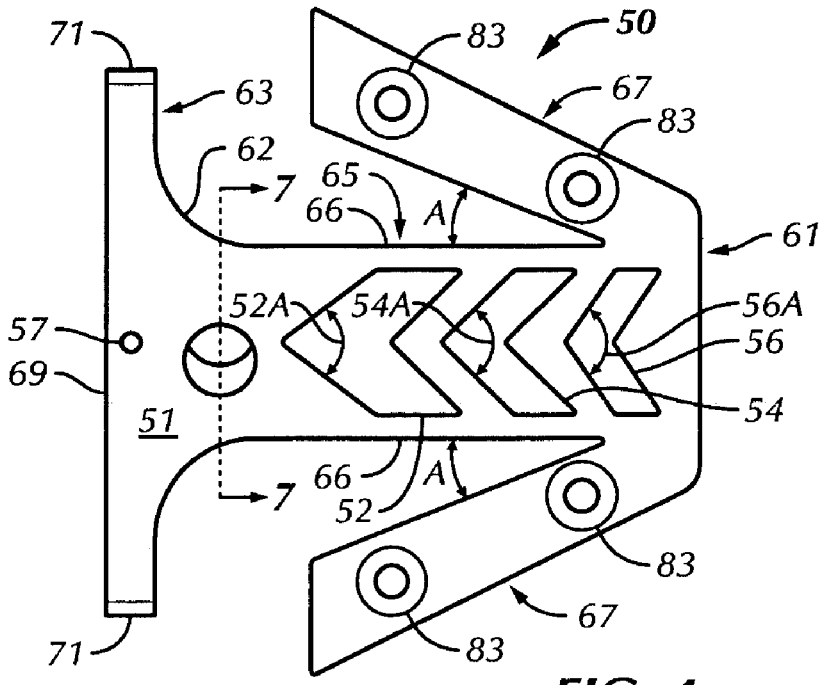
FIG. 4 is a top view of the rear piece of the golf putter head shown in FIG. 1.

Arrowhead-shaped openings 52, 54 and 56 having the arrowhead angles shown in FIG. 4 also are examples of arrowhead shapes that "increase in speed" toward the strike face or front of the putter head (because each successive arrowhead angle moving toward the strike face decreases in size). Such shapes can provide a visual reminder to the player to accelerate the putter through impact, rather than decelerating it (which, for some players, may result in a poorly-struck putt). Each embodiment of the present rear pieces shown in the figures include arrowhead-shaped openings with the properties (including the arrowhead angles) discussed in this paragraph.

Rear piece 50 also includes a rear piece bore 57, which extends into rear piece 50 from top surface 51. Rear piece bore 57 can extend any desired distance into rear piece 50, can be smaller in diameter (or, more generally, cross-sectional area) than front piece bore 25, and can be at least partially aligned (and, in this embodiment, aligned; more generally, it can be substantially aligned) with front piece bore 25. The bottom and/or inside wall of rear piece bore 57 can be painted or otherwise provided with any desired color (e.g., a fluorescent color) that can stand out to a player looking down through front piece bore 25. In some embodiments, a rear piece bore does not exist, and the front piece bore 25 extends only partially into front piece 10 without passing through to any recesses within front piece 10 (those recesses are discussed below in more detail). In such embodiments, the bottom and/or inside wall of front piece bore 25 can be painted or otherwise provided with any desired color that can stand out to a player looking down into front piece 25.

Figure 5:
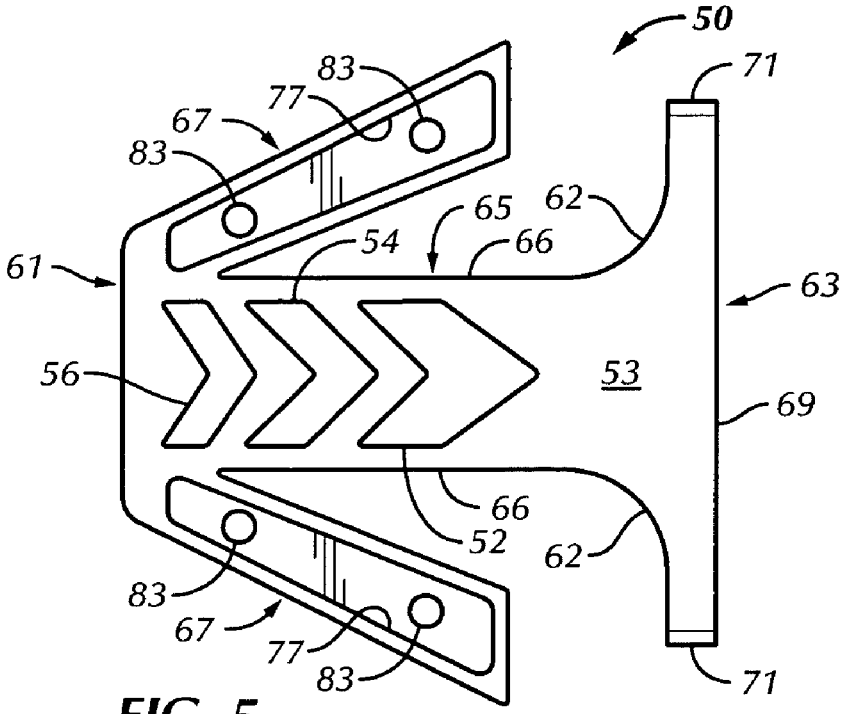
FIG. 5 is a bottom view of the rear piece of the golf putter head shown in FIG. 1.

As shown in FIGS. 4 and 5, rear piece 50 includes a back end designated generally as 61, a forward portion designated generally as 63, a central portion designated generally as 65 that extends away from forward portion 63, and two rear side arms designated generally as 67. Each rear side arm 67 is substantially identical (and, in this embodiment, identical) in shape, and extends toward, but terminates prior to, forward portion 63 at an angle A (and, in this embodiment, at a constant angle for the length of the rear side arm) to central portion 65. Each rear side arm 67 also can be characterized as extending from back end 61 and central portion 65 toward front piece 10 (see FIGS. 1 and 2) and forward portion 63 at an angle A to central portion 65. Each rear side arm 67 terminates in an end surface (unlabeled) that is substantially parallel (and, in this embodiment, parallel) to the surface defining back end 61, front face 69 of forward portion 63, rear surface 17 of front piece 10, and the top and bottom edges (unlabeled) bordering strike face 12.

Forward portion 63 is separated from central portion 65 by fillets 62. Front face 69 of forward portion 63 is substantially flat (and, in this embodiment, flat) and substantially perpendicular (and, in this embodiment, perpendicular) to top surface 51. Forward portion 63 also includes two side faces 71 that are substantially flat (and, in this embodiment, flat), substantially parallel (and, in this embodiment, parallel) to each other, and substantially perpendicular (and, in this embodiment, perpendicular) to top surface 51 and a portion of bottom surface 53. Top surface 51 and side faces 71 are connected by two fillets 73, as are side faces 71 and bottom surface 53. Forward portion 63 also includes two fastener openings 74, each being configured to accept a fastener (e.g., screw 22) that will help to keep rear piece 50 connected (and, in this embodiment, removably connected) to front piece 10. In the embodiment shown, fastener openings 74 both comprise screw openings.

Central portion 65 includes the arrowhead-shaped openings 52, 54 and 56, and has two sides 66 that are substantially flat (and, in this embodiment, flat), substantially parallel (and, in this embodiment, parallel) to each other, and that are substantially perpendicular (and, in this embodiment, perpendicular) to top surface 51. A putter shaft hosel bore 75 extends from top surface 51 into rear piece 50, as shown most clearly in the cross-sectional view of FIG. 7. Hosel bore 75 may be oriented at any suitable angle to top surface 51 and may have any suitable depth, including the angle and depth shown in FIG. 7.

Figure 6:
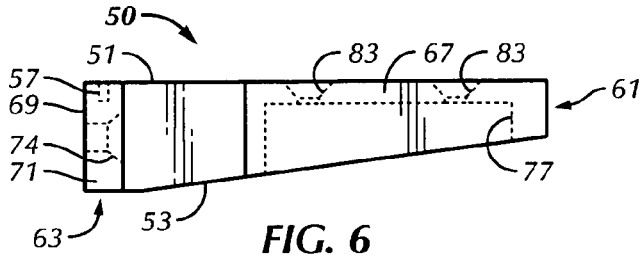
FIG. 6 is a left side view of the rear piece of the golf putter head shown in FIG. 1, with hidden features (such as a weight recess) depicted in dashed lines, the right side view being a mirror image.

As FIG. 6 shows, top surface 51 of rear piece 50 can be substantially flat (and, in this embodiment, flat). Most of bottom surface 53 of rear piece 50 can be oriented at a non-perpendicular angle (including the angle depicted in FIG. 6) to front face 69. Most of bottom surface 53 of rear piece 50 also can be oriented at a non-zero angle (including the angle depicted in FIG. 6) to top surface 51. For example, most of bottom surface 53 can be oriented at an angle to top surface 51 that gives the majority of rear piece 50 a tapered appearance moving from forward portion 63 toward back end 61. For example, rear side arms 67 each have a tapered appearance moving from forward portion 63 toward back end 61. Thus, the majority of rear piece 50 and all of rear side arms 67 may be characterized as tapered from front to back.

Rear piece 50 also includes one or more weight recesses that extend from bottom surface 53 into rear piece 50. More specifically, rear piece 50 includes a weight recess 77 (also characterizable as a side arm weight recess) that extends from the portion of bottom surface 53 that exists on rear side arms 67 into each rear side arm 67. As FIG. 5 shows, the side walls of each weight recess 77 can be substantially parallel (and, in this embodiment, parallel) to the sides of the rear side arm 67 in which it resides. The surface that defines the innermost surface of each weight recess 77 can be substantially parallel (and, in this embodiment, parallel) to top surface 51 of rear piece 50. This is true of all the innermost surfaces of all the weight recesses and top surfaces of the embodiments of the rear pieces illustrated in the figures. In other embodiments, this need not be true.

Weights 79 may be configured to fit within weight recesses 77, and may be further configured to be connected (and, in this embodiment, removably connected) to rear piece 50. The latter configuration can be achieved, for example, by providing one or more fastener openings (e.g., screw openings, or holes) 81 in weights 79. Rear side arms 67 can also be configured to be connected (and, in this embodiment, removably connected) to weights 79. That configuration can be achieved, for example, by providing one or more fastener openings 83 (e.g., screw openings, or holes) in each rear side arm 67 that correspond in location to the one or more screw openings 81 in weights 79. Fasteners, such as screws 82, can be used to achieve the removable connection between rear piece 50 (and, more specifically, rear side arms 67) and weights 79.

Figure 2:
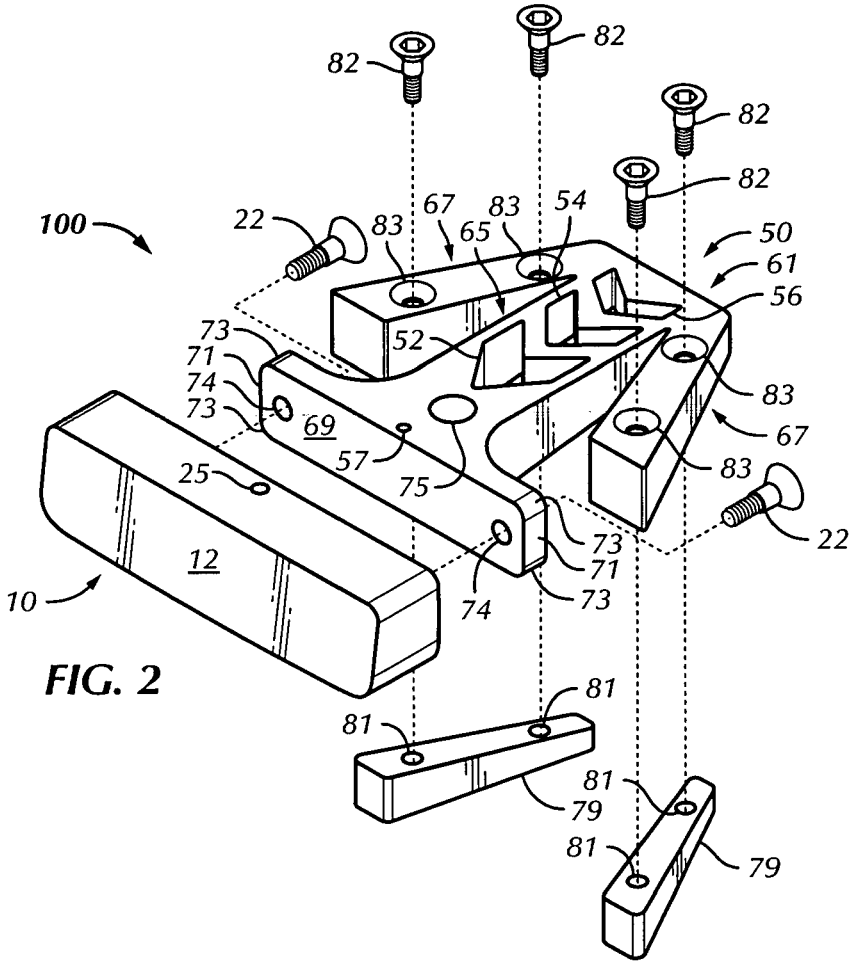
FIG. 2 shows an exploded view of the golf putter head shown in FIG. 1.
Figure 3:
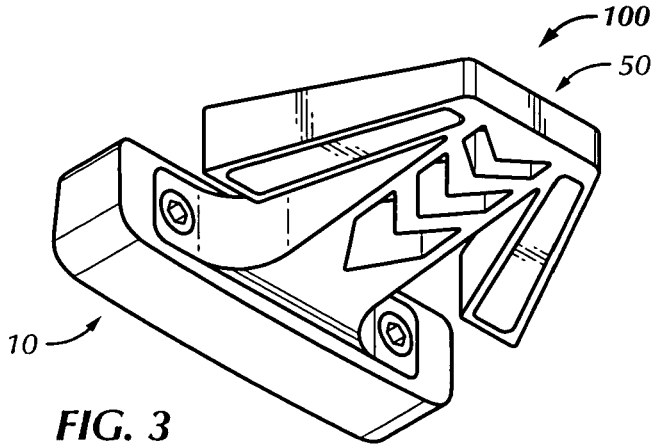
FIG. 3 is a perspective view of the back, bottom and left side of the golf putter head shown in FIG. 1.

A given weight 79 also can be configured to fit within a weight recess 77 such that the gaps between the side surfaces of the weights and the side walls of the weight recess are minimized, as shown in FIG. 2. In other words, the fit between a given weight 79 and a given weight recess 77 can be snug, or the tolerances pertaining to the fit of the two items can be small. A given weight 79 also can be configured such that the bottom surface of the weight has a shape that is substantially coplanar (and, in this embodiment, coplanar) with the portion of bottom surface 53 that defines the bottom of rear side arms 67. Weights 79 are examples of weights that are positioned at least partially in their corresponding weight recesses 77. Weights 79 may also be characterized as tapered from front to back.

The bottom surface of a given weight 79 can be configured to reside within a weight recess 77, outside of it, or substantially flush with it (as in the case shown in FIG. 2), depending on the desired size of the weight. A player can find the weight system, or weight combination, that works best for him or her by trying out golf putter heads with differently-sized weights. Alternatively, the present weights can be made from different materials to achieve different weights. As yet another alternative, certain of the present weights can be provided with cavities or the like (not shown in the figures) to alter their mass but leave their original exterior profile. The present weights that are removably connected to the present rear pieces may be part of an "adjustable weight system" of the present golf putter heads. This is true for each embodiment of the present golf putter heads that have weight recesses.

The weights 79 of golf putter head 100 can be positioned generally about portions of the perimeter of rear piece 50, as shown for example in FIG. 2. The addition of weights 79 to rear piece 50 give golf putter head 100 a higher moment of inertia than golf putter head 100 would have without weights 79. By increasing the moment of inertia of the putter head, the resistance of the putter head to twisting when a putt is hit off-center is reduced.

Figure 11:
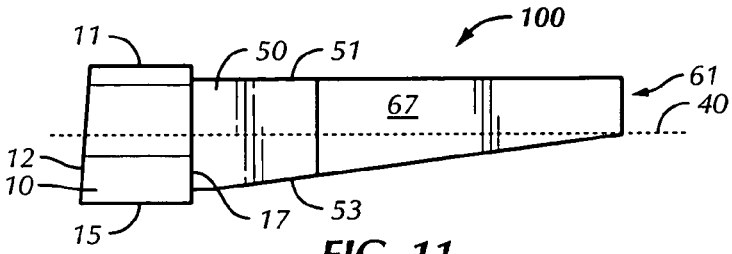
FIG. 11 is a left side view of the golf putter head shown in FIG. 1 in which a plane intersects the front and rear pieces and illustrates that a majority of the mass of the rear piece is positioned above the plane.
Figure 12:
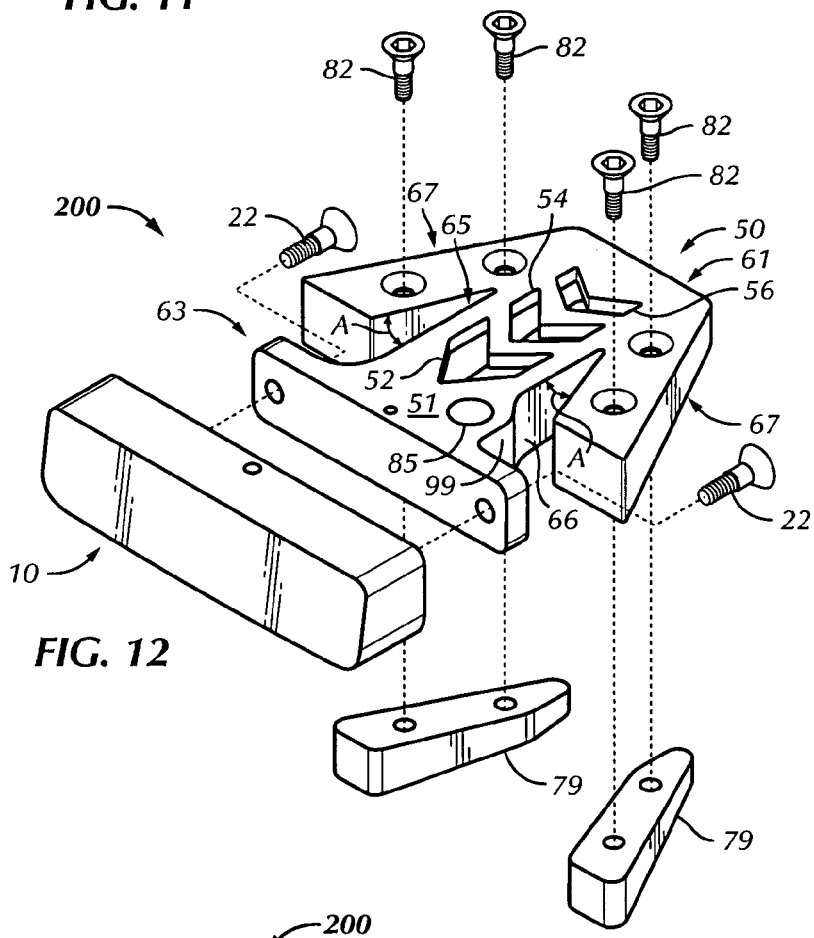
FIG. 12 is an exploded perspective view of another embodiment of the present golf putter heads.
Figure 13:
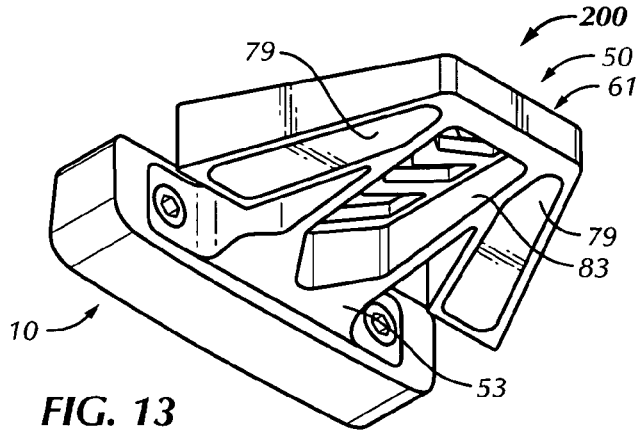
FIG. 13 is a perspective view of the back, bottom and left side of an assembled version of the golf putter head shown in FIG. 12.
Figure 14:
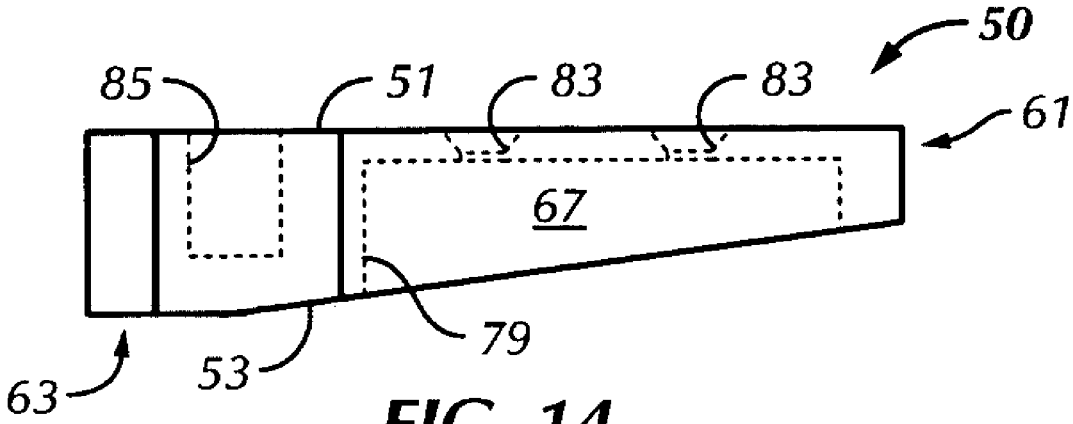
FIG. 14 is a left side view of the rear piece of the golf putter head shown in FIG. 12, with certain hidden features depicted in dashed lines, the right side view being a mirror image.
Figure 15:
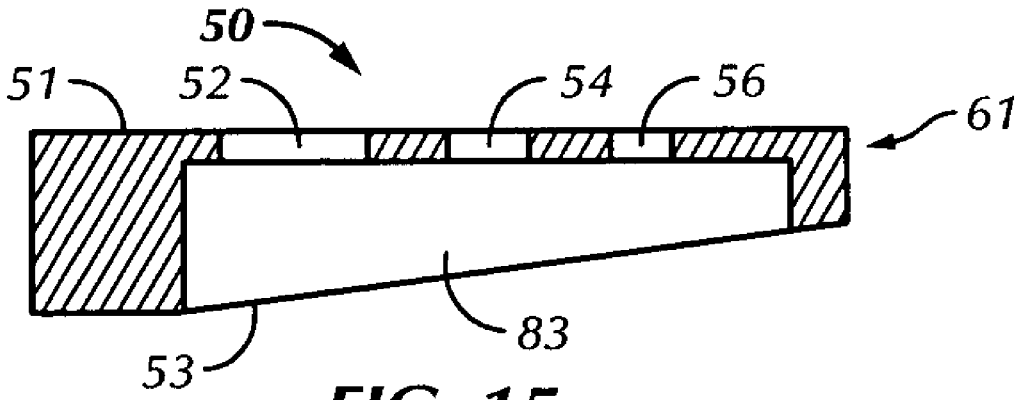
FIG. 15 is a cross sectional view taken through the center of the rear piece of the golf putter head shown in FIG. 12, showing the shape of the central portion recess.

FIG. 11 illustrates that the majority of the mass of rear piece 50 is in its top "half." FIG. 11 shows a plane 40 that intersects strike face 12 substantially mid-way (and, in this embodiment, mid-way) between top surface 11 and bottom surface 15 (e.g., the lowest portion of bottom surface 15), and extends into and through rear piece 50 (although it need not extend through the portion of rear piece 50 that forms back end 61). As FIG. 11 shows, a majority of the mass of rear piece 50 is positioned above plane 40. Plane 40 is substantially parallel (and, in this embodiment, parallel) to top surface 11 of front piece 10 and to top surface 51 of rear piece 50. Although the remaining figures do not show plane 40, all the embodiments of the rear pieces shown in the figures are configured such that a majority of the mass of each respective rear piece is positioned above a plane that (a) intersects the strike face of the corresponding front piece substantially mid-way (e.g., mid-way) between the top and bottom surfaces of that front piece, and (b) extends into and through the respective rear piece.

2. FIGS. 12-15

FIGS. 12-15 show different views of another embodiment of the present golf putter heads—golf putter head 200. Golf putter head 200 is similar to golf putter head 100. Both include the same version of front piece 10. However, the version of rear piece 50 that forms part of golf putter head 200 is different from the version of rear piece 50 depicted throughout FIGS. 1-11. Those differences are illustrated in the figures.

For example, while rear side arms 67 of golf putter head 200 are similar to the rear side arms 67 of golf putter head 100 in that each rear side extends toward, but terminates prior to, forward portion 63 at an angle A (and, in this embodiment, at a constant angle for the length of the rear side arm) to central portion 65 (and each rear side arm also can be characterized as extending from back end 61 and central portion 65 toward front piece 10 and forward portion 63 at an angle A to central portion 65), the inner side of each rear side arm 67 of golf putter head 200 is shorter than in the version shown throughout FIGS. 1-11. Rear side arms 67 of golf putter head 200 also are wider (laterally) than the rear side arms 67 of golf putter head 100.

One side 66 of central portion 65 of golf putter head 200 includes a bulge 99 designed to accommodate an offset hosel bore 85 that extends from top surface 51 of rear piece 50 and into rear piece 50. Offset hosel bore 85 can have any suitable depth (including the one shown in FIG. 14) and may be placed at any suitable angle with respect to top surface 51 (including a perpendicular (or at least substantially perpendicular) angle). (Central portion 65 of golf putter head 100 can be provided, in an alternative embodiment from what is shown throughout FIGS. 1-11, with a bulge 99 and an offset hosel bore 85 just like those shown in FIGS. 12-15.)

Central portion 65 of rear piece 50 includes a central portion recess 83 that extends from bottom surface 53 toward (but does not reach) top surface 51. The perimeter of the outer wall defining central portion recess 83 is larger than the perimeter defined by the outermost portions of arrowhead-shaped openings 52, 54 and 56. The surface that defines the innermost surface of central portion recess 83 can be substantially parallel (and, in this embodiment, parallel) to top surface 51 of rear piece 50. (Central portion 65 of golf putter head 100 can be provided, in an alternative embodiment from what is shown throughout FIGS. 1-11, with a central portion recess 83 just like the one shown in FIGS. 12-15.)

3. FIGS. 16-18

Figure 7:
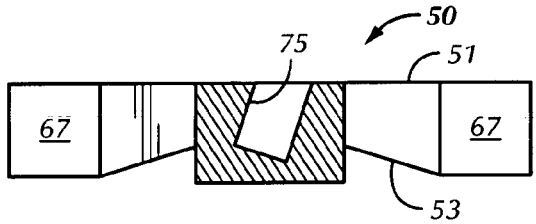
FIG. 7 is a cross-sectional view taken along line 7-7 in FIG. 4.
Figure 16:
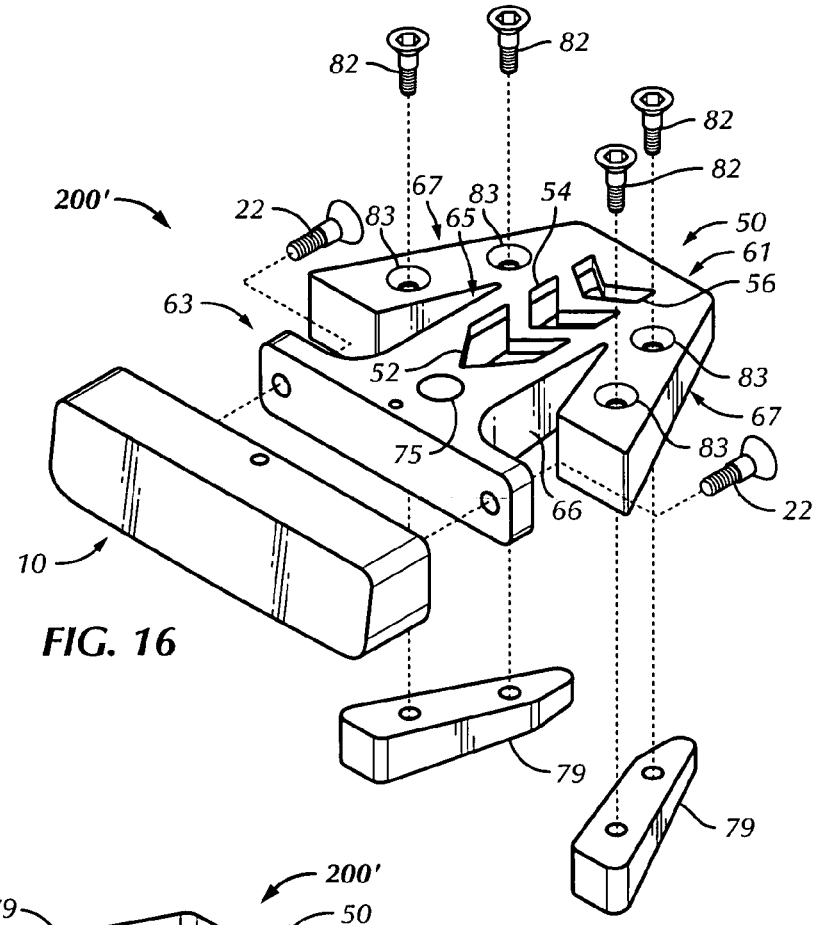
FIG. 16 an exploded perspective view of another embodiment of the present golf putter heads.
Figure 17:
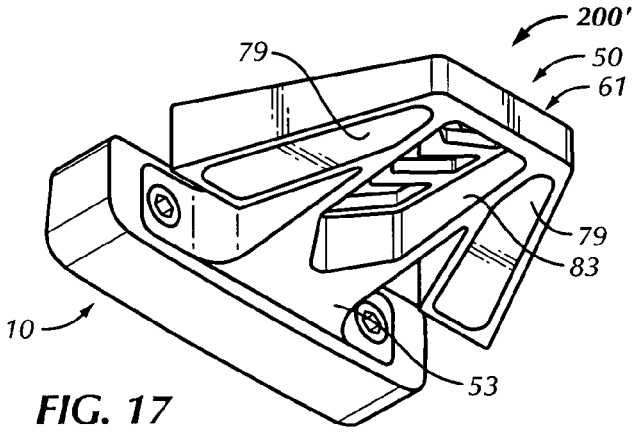
FIG. 17 is a perspective view of the back, bottom and left side of an assembled version of the golf putter head shown in FIG. 16.
Figure 18:
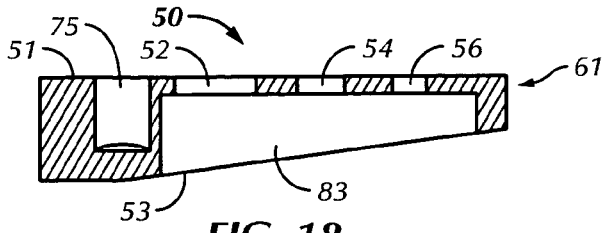
FIG. 18 is a cross sectional view taken through the center of the rear piece of the golf putter head shown in FIG. 16, showing the shape of the central portion recess.

Golf putter head 200', shown in FIGS. 16-18, is just like golf putter head 200 except that it has a "centered" hosel bore 75 (set at any suitable depth and angle, including the depth and angle shown in FIG. 7), and lacks the bulge 99, and has a differently-sized central portion recess 83.

4. FIGS. 19-20

Figure 19:
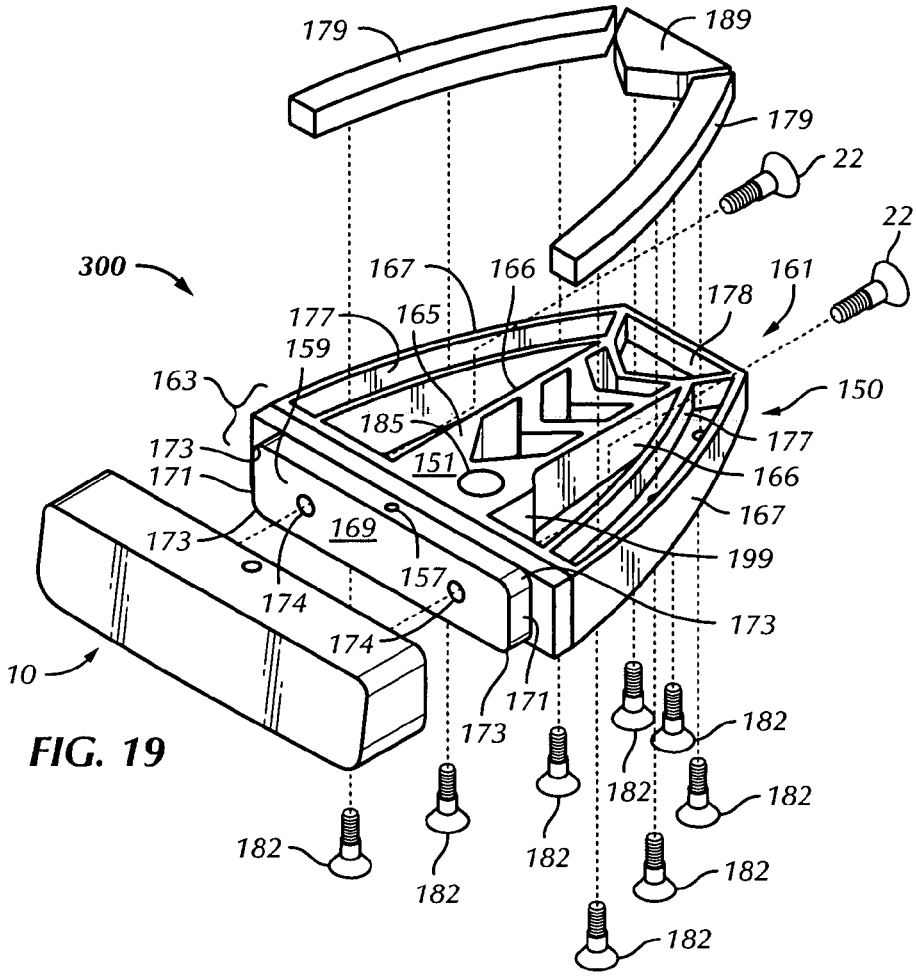
FIG. 19 is an exploded perspective view of another embodiment of the present golf putter heads.
Figure 20:
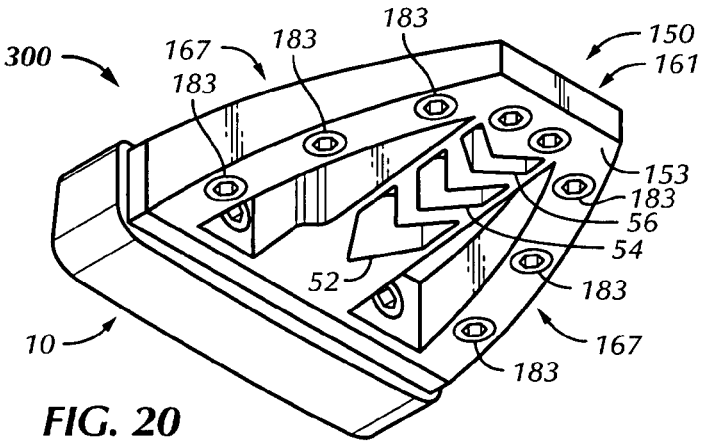
FIG. 20 is a perspective view of the back, bottom and left side of an assembled version of the golf putter head shown in FIG. 19.

FIGS. 19-20 illustrate golf putter head 300, another embodiment of the present golf putter heads. The rear side arms of this embodiment extend into the forward portion of the rear piece and are curved, and the weight recesses of the rear piece extend into it from the top surface.

Rear piece 150 of golf putter head 300 includes a forward portion 163 that includes a male insert portion 159 that is configured to fit at least partially within (and, in this embodiment, within) first recess 32 of front piece 10. The remainder of forward portion 163 is the widest part of rear piece 150.

Rear piece 150 includes a back end designated generally as 161, a central portion designated generally as 165 that extends away from forward portion 163, and two rear side arms designated generally as 167. Each rear side arm 167 is substantially identical (and, in this embodiment, identical) in shape, and extends into forward portion 163. Each rear side arm 167 also can be characterized as extending from back end 161 and central portion 165 toward front piece 10 and forward portion 163. Each rear side arm 167 is curved. Both of the two openings formed in rear piece 150 that are bordered by a portion of forward portion 163, a portion of a given rear side arm 167, and a portion of central portion 165 are shaped like right triangles with a curved hypotenuse.

Front face 169 of insert portion 159 is substantially flat (and, in this embodiment, flat) and substantially perpendicular (and, in this embodiment, perpendicular) to top surface 151. Insert portion 159 also includes two side faces 171 that are substantially flat (and, in this embodiment, flat), substantially parallel (and, in this embodiment, parallel) to each other, and substantially perpendicular (and, in this embodiment, perpendicular) to top surface 151 and a portion of bottom surface 153. The top surface of insert portion 159 and side faces 171 are connected by two fillets 173, as are side faces 171 and the bottom surface of insert portion 159.

Forward portion 163 includes two fastener openings 174, each being configured to accept a fastener (e.g., screw 22) that will help to keep rear piece 150 connected (and, this embodiment, removably connected) to front piece 10. In the embodiment shown, fastener openings 174 both comprise screw openings.

Rear piece 150 also includes a rear piece bore 157, which extends into rear piece 150 from top surface 151. Rear piece bore 157 can extend any desired distance into rear piece 150, can be smaller in diameter (or, more generally, cross-sectional area) than front piece bore 25, and can be at least partially aligned (and, in this embodiment, aligned; more generally, it can be substantially aligned) with front piece bore 25. The bottom and/or inside wall of rear piece bore 157 can be painted or otherwise provided with any desired color (e.g., a fluorescent color) that can stand out to a player looking down through front piece bore 25. In some embodiments, a rear piece bore does not exist, and the front piece bore 25 extends only partially into front piece 10 without passing through to any recesses within front piece 10 (those recesses are discussed below in more detail). In such embodiments, the bottom and/or inside wall of front piece bore 25 can be painted or otherwise provided with any desired color that can stand out to a player looking down into front piece 25.

Central portion 165 has two sides 166 that are substantially flat (and, in this embodiment, flat), substantially parallel (and, in this embodiment, parallel) to each other, and that are substantially perpendicular (and, in this embodiment, perpendicular) to top surface 151. One side 166 of central portion 165 of golf putter head 300 includes a bulge 199 designed to at least partially accommodate an offset hosel bore 185 that extends from top surface 151 of rear piece 150 and into rear piece 150. Offset hosel bore 185 can have any suitable depth (including the one shown in FIG. 14) and may be placed at any suitable angle with respect to top surface 151 (including a perpendicular angle).

Top surface 151 of rear piece 150 can be substantially flat (and, in this embodiment, flat). Most of bottom surface 153 of rear piece 150 can be oriented at a non-perpendicular angle to front face 169. Most of bottom surface 153 of rear piece 150 also can be oriented at a non-zero angle to top surface 151. For example, most of bottom surface 153 can be oriented at an angle to top surface 151 that gives the majority of rear piece 150 a tapered appearance moving from forward portion 163 toward back end 161. For example, rear side arms 167 each have a tapered appearance moving from forward portion 163 toward back end 161. Thus, the majority of rear piece 150 and all of rear side arms 167 may be characterized as tapered from front to back.

Rear piece 150 also includes one or more weight recesses that extend from top surface 151 into rear piece 150. More specifically, rear piece 150 includes two side arm weight recess 177 that each extends from the portion of top surface 151 that exists on rear side arms 167 into each rear side arm 167. Furthermore, rear piece 150 also includes a back end weight recess 178 that extends into it from top surface 151 near back end 161.

Side arm weights 179 may be configured to fit within side arm weight recesses 177, and may be further configured to be removably connected to rear piece 150. The latter configuration can be achieved, for example, by providing one or more fastener openings (e.g., screw holes; not visible) in side arm weights 179. Rear side arms 167 also can be configured to be removably connected to side arm weights 179. That configuration can be achieved, for example, by providing one or more fastener openings 183 (e.g., screw holes) in each rear side arm 167 that correspond in location to the one or more screw openings in side arm weights 179. Fasteners, such as screws 182, can be used to achieve the removable connection between rear piece 150 (and, more specifically, rear side arms 167) and side arm weights 179.

A back end weight 189 may be configured to fit within back end weight recess 178, and may be further configured to be removably connected to rear piece 150. The latter configuration can be achieved, for example, by providing one or more screw openings (e.g., holes; not visible) in back end weight 189. Rear piece 150 can be configured to be removably connected to back end weight 189. That configuration can be achieved, for example, by providing one or more fastener openings (and, in this embodiment, screw openings; not visible) in rear piece 150 that correspond in location to the one or more screw openings in back end weight 189. Fasteners, such as screws 182, can be used to achieve the removable connection between rear piece 150 and back end weight 189.

A given weight (e.g., side arm weights 179 or back end weight 189) can be configured to fit within its corresponding rear piece weight recess such that the gaps between the side surfaces of the weight and the side walls of the weight recess are minimized. In other words, the fit between a given rear weight and a given rear weight recess can be snug, or the tolerances pertaining to the fit of the two items can be small. Side arm weights 179 and back end weight 189 are examples of weights that are positioned at least partially in their corresponding weight recesses.

The top surface of a given rear weight of golf putter head 300 can be configured to reside within its corresponding weight recess, outside of that weight recess, or substantially flush with it, depending on the desired size of the weight.

5. FIGS. 21-22

Figure 21:
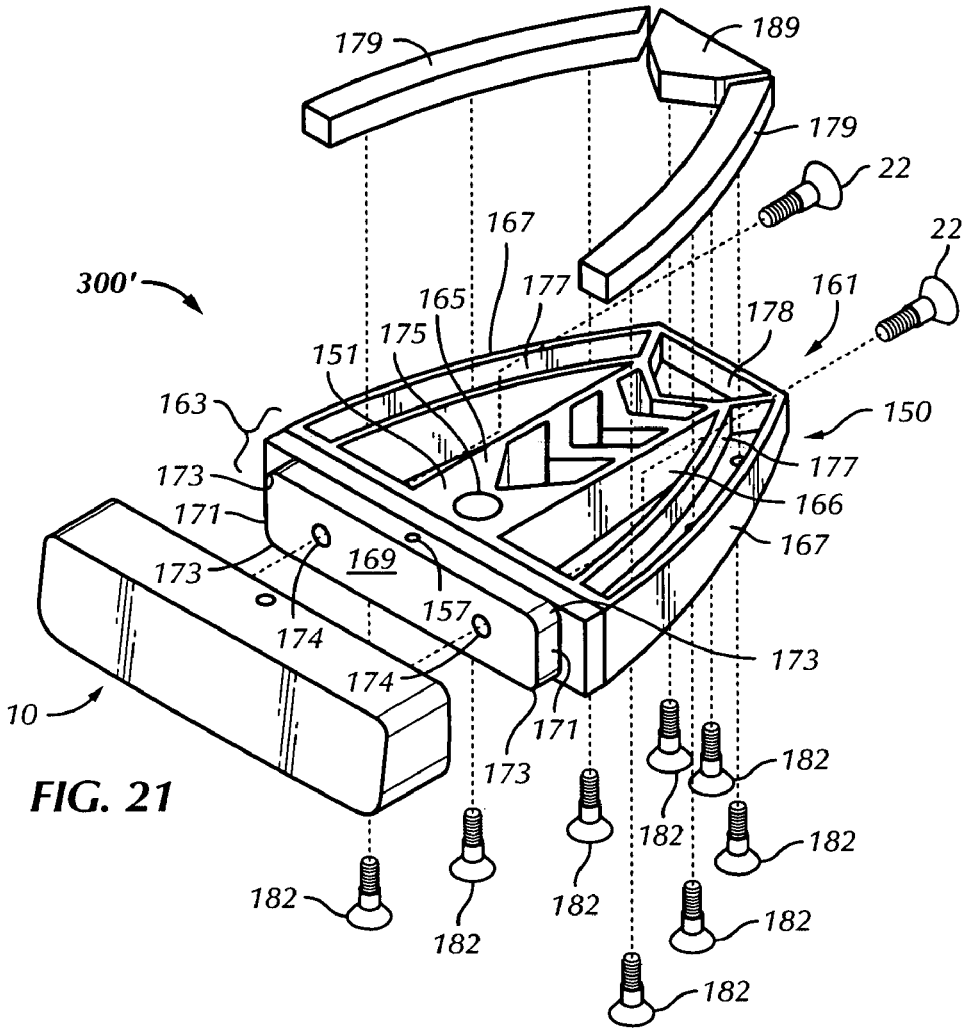
FIG. 21 is an exploded perspective view of another embodiment of the present golf putter heads.
Figure 22:
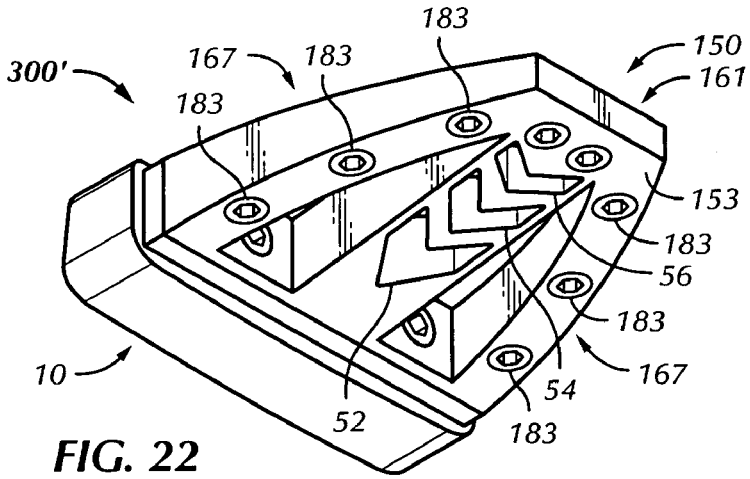
FIG. 22 is a perspective view of the back, bottom and left side of an assembled version of the golf putter head shown in FIG. 21.

Golf putter head 300', shown in FIGS. 21-22, is just like golf putter head 300 except that it has a "centered" hosel bore 175 (set at any suitable depth and angle, including the depth and angle shown in FIG. 7), and lacks the bulge 199.

6. FIGS. 23-24

Figure 23:
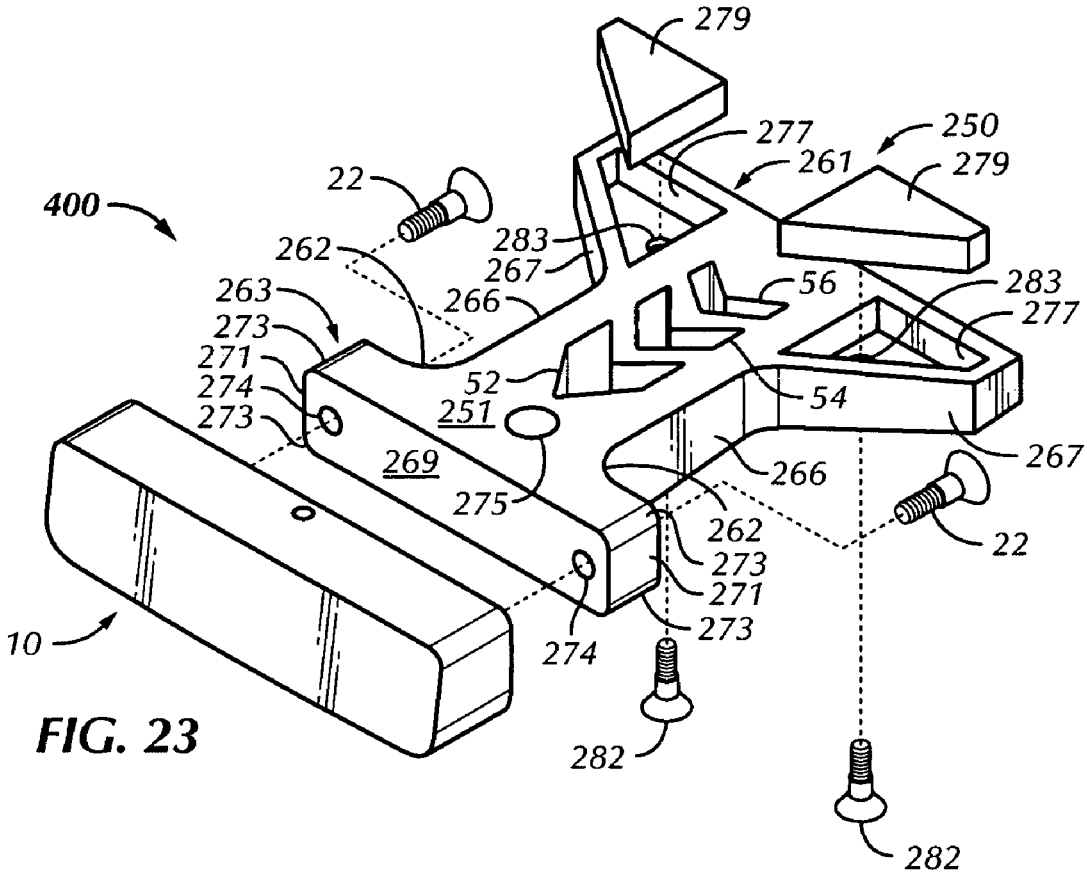
FIG. 23 is an exploded perspective view of another embodiment of the present golf putter heads.
Figure 24:
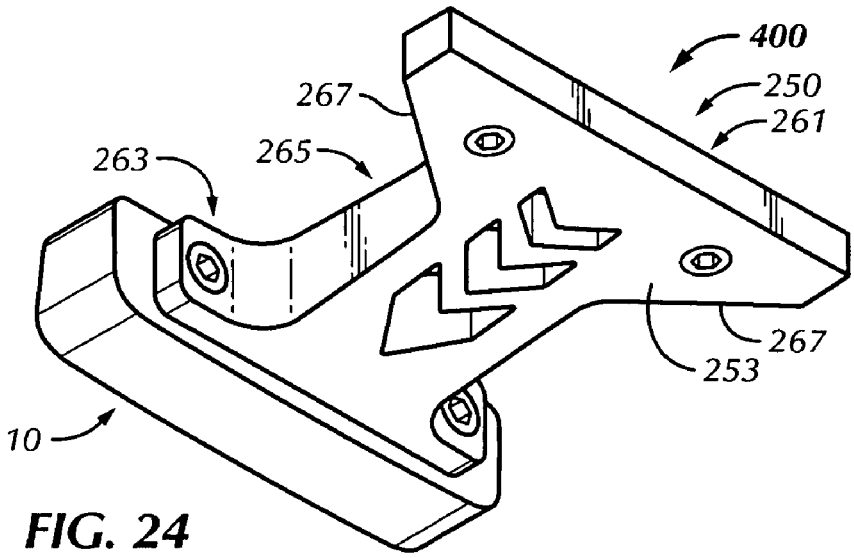
FIG. 24 is a perspective view of the back, bottom and left side of an assembled version of the golf putter head shown in FIG. 23.

FIGS. 23-24 illustrate golf putter head 400, another embodiment of the present golf putter heads. Rear piece 250 of this embodiment of the present golf putter heads includes a back end designated generally as 261, a forward portion designated generally as 263, a central portion designated generally as 265 that extends away from forward portion 263, and two rear side arms 267 that each extends from central portion 265 of this embodiment and at least partially define back end 261, giving a rear portion of rear piece 250 a wedge-like shape. Each rear side arm 267 is substantially identical (and, in this embodiment, identical) in shape, and extends at an angle (and, in this embodiment, at a constant angle for the length of the forward-most side of the rear side arm) to central portion 265.

Each rear side arm 267 terminates in an end surface (unlabeled) that is substantially parallel (and, in this embodiment, parallel) to side surfaces 266 of central portion 265; and substantially perpendicular (and, in this embodiment, perpendicular) to top surface 251, the surface defining back end 261, front face 269 of forward portion 263, the rear surface 17 of front piece 10, and the top and bottom edges (unlabeled) bordering strike face 12. Front face 269 of forward portion 263 is substantially flat (and, in this embodiment, flat) and substantially perpendicular (and, in this embodiment, perpendicular) to top surface 251.

Forward portion 263 is thicker than other forward portions illustrated in the figures, and does not fit flush with rear surface 17 of front piece 10. Forward portion 263 includes two side faces 271 that are substantially flat (and, in this embodiment, flat), substantially parallel (and, in this embodiment, parallel) to each other, and substantially perpendicular (and, in this embodiment, perpendicular) to top surface 251 and a portion of bottom surface 253. Top surface 251 and side faces 271 are connected by two fillets 273, as are side faces 271 and bottom surface 253. Forward portion 263 also includes two fastener openings 274, each being configured to accept a fastener (e.g., screw 22) that will help to keep rear piece 350 connected (and, in this embodiment, removably connected) to front piece 10. In the embodiment shown, fastener openings 274 both comprise screw openings.

Although not shown, in one embodiment, rear piece 250 can include a rear piece bore that is the same in configuration as rear piece bore 57 shown throughout FIGS. 1-11. Such a rear piece bore can be treated (e.g., with fluorescent paint or the like) in the same manner as rear piece bore 57 described above.

Central portion 265 has two sides 266 that are substantially flat (and, in this embodiment, flat), substantially parallel (and, in this embodiment, parallel) to each other, and that are substantially perpendicular (and, in this embodiment, perpendicular) to top surface 251. Forward portion 263 is separated from central portion 265 by fillets 262.

While rear piece 250 includes a "centered" hosel bore 275 (which can be identical in configuration to hosel bore 75 illustrated in previous figures and discussed above), in an alternative embodiment, one side 266 of central portion 265 can include a bulge designed to accommodate an offset hosel bore that extends from top surface 251 of rear piece 250 and into rear piece 250. Such an offset hosel bore can have any suitable depth (including the one shown in FIG. 14 for offset hosel bore 85) and may be placed at any suitable angle with respect to top surface 251 (including a perpendicular angle).

Top surface 251 of rear piece 250 can be substantially flat (and, in this embodiment, flat). Most of bottom surface 253 of rear piece 250 can be oriented at a non-perpendicular angle to front face 269. Most of bottom surface 253 of rear piece 250 also can be oriented at a non-zero angle to top surface 251. For example, most of bottom surface 253 can be oriented at an angle to top surface 251 that gives the majority of rear piece 250 a tapered appearance moving from forward portion 263 toward back end 261. For example, rear side arms 267 each have a tapered appearance (e.g., a tapered side profile) moving from forward portion 263 toward back end 261. Thus, the majority of rear piece 250 and all of rear side arms 267 may be characterized as tapered from front to back.

Rear piece 250 also includes one or more weight recesses that extend from top surface 251 into rear piece 250. More specifically, rear piece 250 includes two side arm weight recess 277 that each extends from the portion of top surface 251 that exists on rear side arms 267 into each rear side arm 267. Side arm weights 279 may be configured to fit within side arm weight recesses 277, and may be further configured to be removably connected to rear piece 250. The latter configuration can be achieved, for example, by providing one or more fastener openings (e.g., screw holes; not visible) in side arm weights 279. Rear side arms 267 also can be configured to be removably connected to side arm weights 279. That configuration can be achieved, for example, by providing one or more fastener openings 283 (and, in this embodiment, screw openings) in each rear side arm 267 that correspond in location to the one or more screw openings in side arm weights 279. Fasteners, such as screws 282, can be used to achieve the removable connection between rear piece 250 (and, more specifically, rear side arms 267) and side arm weights 279.

The top surface of a given rear weight of golf putter head 400 can be configured to reside within its corresponding weight recess, outside of that weight recess, or substantially flush with it, depending on the desired size of the weight.

7. FIGS. 25-27

Figure 25:
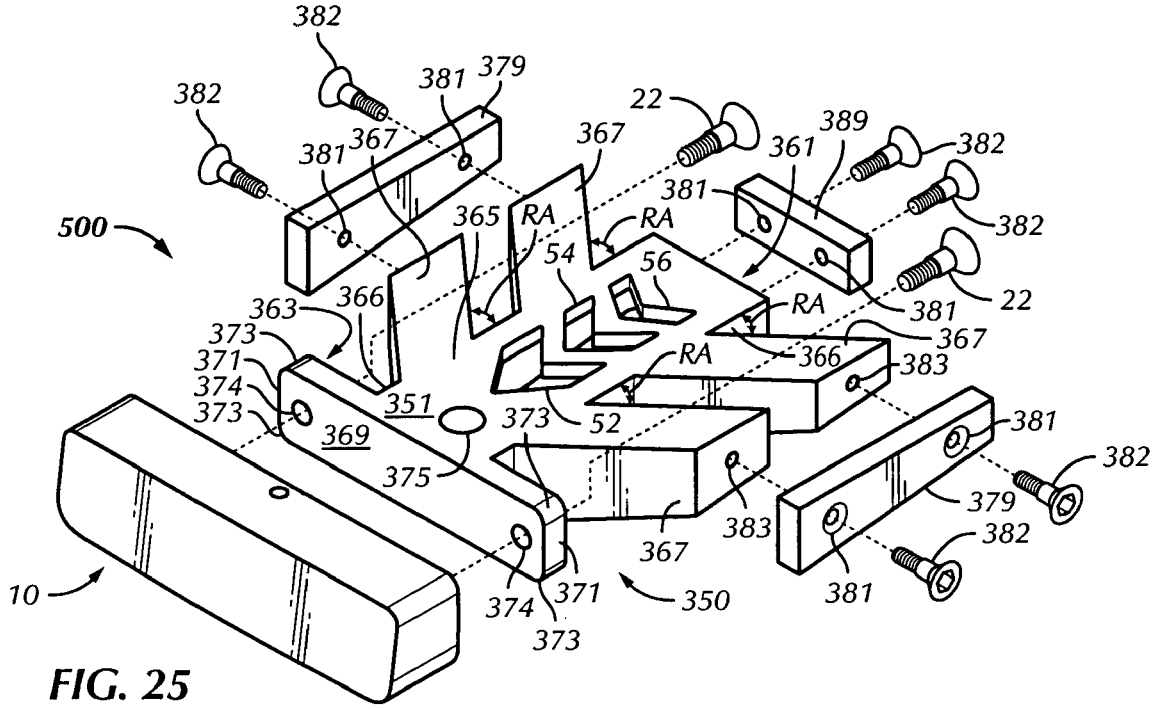
FIG. 25 is an exploded perspective view of another embodiment of the present golf putter heads.
Figure 26:
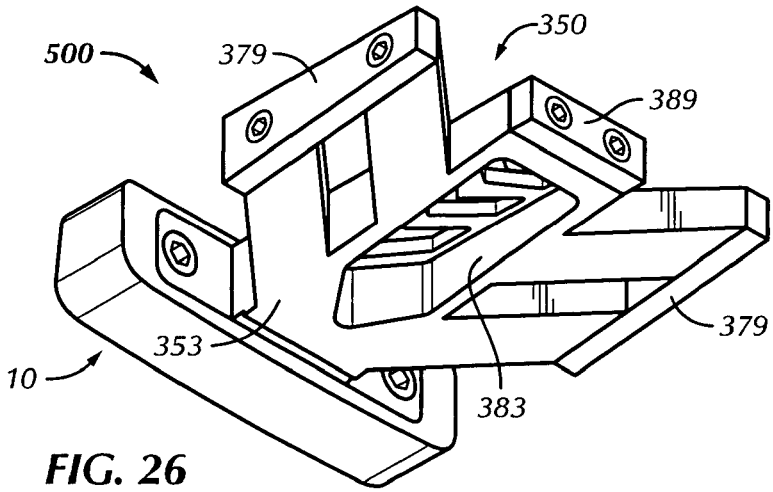
FIG. 26 is a perspective view of the back, bottom and left side of an assembled version of the golf putter head shown in FIG. 25.
Figure 27:
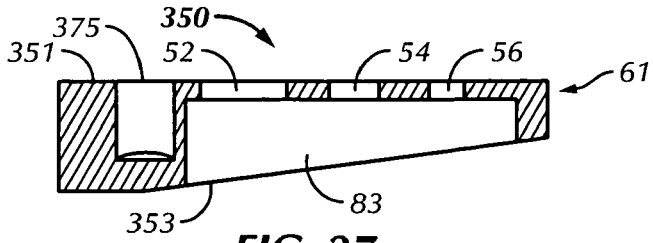
FIG. 27 is a cross sectional view taken through the center of the rear piece of the golf putter head shown in FIG. 25, showing the shape of the central portion recess.

FIGS. 25-27 illustrate golf putter head 500, another embodiment of the present golf putter heads. This embodiment has two sets of rear side arms that extend away from the forward portion of the rear piece and from the front piece, instead of toward those items as shown for example in FIGS. 1-11. Furthermore, the weights connected to the periphery of the rear piece of this embodiment are connected to the laterally-facing ends of the rear side arms ends and/or the laterally-facing back end of the rear piece. This contrasts with the weights positioned in weight recesses, as shown for example in FIGS. 23-24.

Rear piece 350 includes a back end designated generally as 361, a forward portion designated generally as 363, a central portion designated generally as 365 that extends from forward portion 363 to back end 361, and two sets of rear side arms, each rear side arm being designated generally as 367. Each rear side arm 367 is substantially identical (and, in this embodiment, identical) in shape, and extends at an angle RA (and, in this embodiment, at a constant angle for the length of the rear side arm) from one side of central portion 365 and away from forward portion 363 and front piece 10.

Each rear side arm 367 terminates in an end surface (unlabeled) that is substantially perpendicular (and, in this embodiment, perpendicular) to top surface 351, the surface defining back end 361, front face 369 of forward portion 363, the rear surface 17 of front piece 10, and the top and bottom edges (unlabeled) bordering strike face 12. Front face 369 of forward portion 363 is substantially flat (and, in this embodiment, flat) and substantially perpendicular (and, in this embodiment, perpendicular) to top surface 351. Forward portion 363 also includes two side faces 371 that are substantially flat (and, in this embodiment, flat), substantially parallel (and, in this embodiment, parallel) to each other, and substantially perpendicular (and, in this embodiment, perpendicular) to top surface 351 and a portion of bottom surface 353. Top surface 351 and side faces 371 are connected by two fillets 373, as are side faces 371 and bottom surface 353. Forward portion 363 also includes two fastener openings 374, each being configured to accept a fastener (e.g., screw 22) that will help to keep rear piece 350 connected to front piece 10. In the embodiment shown, fastener openings 374 both comprise screw openings.

Although not shown, in one embodiment, rear piece 350 can include a rear piece bore that is the same in configuration as rear piece bore 57 shown throughout FIGS. 1-11. Such a rear piece bore can be treated (e.g., with fluorescent paint or the like) in the same manner as rear piece bore 57 described above.

Central portion 365 has two sides 366 that are substantially flat (and, in this embodiment, flat), substantially parallel (and, in this embodiment, parallel) to each other, and that are substantially perpendicular (and, in this embodiment, perpendicular) to top surface 351. The two rear side arms 367 that are on one side 366 of central portion 365 can be characterized as a first set of rear side arms, and the two rear side arms that are on the other side 366 of central portion 365 can be characterized as a second set of rear side arms.

While rear piece 350 includes a "centered" hosel bore 375 (which can be identical in configuration to hosel bore 75 illustrated in previous figures and discussed above), in an alternative embodiment, one side 366 of central portion 365 can include a bulge designed to accommodate an offset hosel bore that extends from top surface 351 of rear piece 350 and into rear piece 350. Such an offset hosel bore can have any suitable depth (including the one shown in FIG. 14) and may be placed at any suitable angle with respect to top surface 351 (including a perpendicular angle).

Central portion 365 also includes a central portion recess 383 that extends from bottom surface 353 toward (but does not reach) top surface 351. The perimeter of the outer wall defining central portion recess 383 is larger than the perimeter defined by the outermost portions of arrowhead-shaped openings 52, 54 and 56. The surface that defines the innermost surface of central portion recess 383 can be substantially parallel (and, in this embodiment, parallel) to top surface 351 of rear piece 350.

Top surface 351 of rear piece 350 can be substantially flat (and, in this embodiment, flat). Most of bottom surface 353 of rear piece 350 can be oriented at a non-perpendicular angle to front face 369. Most of bottom surface 353 of rear piece 350 also can be oriented at a non-zero angle to top surface 351. For example, most of bottom surface 353 can be oriented at an angle to top surface 351 that gives the majority of rear piece 350 a tapered appearance moving from forward portion 363 toward back end 361. For example, rear side arms 367 each have a tapered appearance (e.g., a tapered side profile) moving from forward portion 363 toward back end 361. Thus, the majority of rear piece 350 and all of rear side arms 367 may be characterized as tapered from front to back.

Side arm weights 379 may be configured to be removably connected to one or more of rear side arms 367. This configuration can be achieved, for example, by providing one or more fastener openings 381 (e.g., holes; and, in this embodiment, screw openings) in side arm weights 379. Rear side arms 367 also can be configured to be removably connected to side arm weights 379. That configuration can be achieved, for example, by providing one or more fastener openings 383 in each rear side arm 367 that correspond in location to the one or more screw openings 381 in side arm weights 379, and that extend from the ends of the side arms laterally toward the center of central portion 365. Fasteners, such as screws 382, can be used to achieve the removable connection between rear piece 350 (and, more specifically, rear side arms 367) and side arm weights 379.

A back end weight 389 can be configured to be removably connected to rear piece 350. This configuration can be achieved, for example, by providing one or more fastener openings 381 in back end weight 389. Rear piece 350 can be configured to be removably connected to back end weight 389. That configuration can be achieved, for example, by providing one or more fastener openings (not visible) in rear piece 350 that correspond in location to the one or more screw openings 381 in back end weight 389, and that extend from the surface defining back end 361 laterally toward forward portion 363. Fasteners, such as screws 382, can be used to achieve the removable connection between rear piece 350 and back end weight 389.

As FIGS. 25-27 show, each rear end weight of golf putter head 500 can have the same outer profile as the outer profile or profiles of the end surfaces to which they are removably connected.

B. Exemplary Materials and Manufacturing Techniques

The present front pieces, rear pieces, and removably-connectable weights may be made from any suitable material, and may be fashioned using any suitable manufacturing technique. In some embodiments, a given front piece can be made from 316 stainless steel or 17-4 PH stainless steel, and a rear piece that is connected (e.g., removably connected) to that front piece can be made from 6061 aluminum. In such embodiments, both pieces can be machined out of bar stock, such as through CNC milling. Embodiments of the present golf putter heads that are made using stainless steel for the front piece and aluminum for the back piece can be characterized as "front-heavy." Suitable materials for embodiments of the present weights that can be connected (e.g., removably connected) to embodiments of the present rear pieces include stainless steel, bronze, tungsten, copper, aluminum, or a mixture of certain of these materials. Certain of the present weights can have portions taken out of them to alter their mass (and, thus, their weight) but maintain their overall exterior geometry (such that two weights having similar or the same exterior geometries have different weights), such as by creating a series of small bores in them. These mass-reducing "chunks" could be taken out of certain of the present weights in any suitable manner, and may be taken specifically out of portions of the weights that are not visible upon inspection of the assembled golf putter head. The fasteners (such as the tapered screws shown in the figures) that can be used to removably connect a weight to a given portion of a rear piece, or a rear piece to a given front piece, may be made from stainless steel, although other materials may be used instead.

The strike faces of embodiments of the present front pieces can be treated in any suitable fashion. For example, in some embodiments, a given strike face can be blasted with a material that is number 10 grit in size or smaller. In other embodiments, a given strike face can be blasted with a material that is number 8 grit in size or smaller. In other embodiments, a given strike face can be blasted with a material that is number 6 grit in size or smaller. Compressed air driven at any suitable pressure (e.g., 60-135 pounds per square inch (psi); 80-95 psi; 85 psi) can be used to drive the blasting media at the strike face. One example of suitable material for such treatment at the number 6 grit size level is aluminum oxide, although other materials can also be used. A strike face treated in any of these manners can be characterized as having "an abrasive blast finish."

The present golf putter heads are not intended to be limited to the particular forms disclosed. Rather, they are to cover all modifications, equivalents, and alternatives falling within the scope of the claims. For example, while the rear pieces of the illustrated embodiments include arrowhead-shaped openings that extend all the way through a given portion of the different rear pieces, other arrowhead shapes are possible. For example, a rear piece that includes two or more arrowhead shapes covers a rear piece that includes a top surface into which two or more arrowhead shapes are etched, laser cut, milled, or the like. A rear piece that includes two or more arrowhead shapes also covers a rear piece having arrowhead-shaped recesses that extend from the top surface of the rear piece toward (but not into) the bottom surface (or, more generally, the bottom) of the rear piece. A rear piece that includes two or more arrowhead shapes also covers a rear piece having arrowhead shapes that are painted onto the top surface of the rear piece, or that form part of a material that is attached to the top of the rear piece in any suitable fashion so as to be visible to the player using the club.

As another example, while not shown in the figures, an alignment line may be provided on the top surface of any embodiment of the present front pieces that extends generally between the strike face and, if provided, a front piece bore extending into the front piece from its top surface. Such an alignment line can be etched, laser cut, milled or the like into the top surface of a given front piece to indicate the center of the strike face of the putter head, thus helping players to strike golf balls with the center of the strike face.

As yet another example, the weight recesses shown in the illustrated embodiments could extend from either the top or bottom surface of the rear pieces. Thus, the weight recesses of the embodiment illustrated in FIGS. 1-11 could, alternatively to what is shown, extend from the top surface and into the rear piece, in similar fashion to what is shown in FIGS. 19-20. And the weight recesses in FIGS. 19-20 could, alternatively to what is shown, extend into the rear piece of that embodiment from the rear piece's bottom surface.

As another example, the embodiments of the present golf putter heads that are shown without recesses in their rear piece central portions (such as the embodiment shown in FIGS. 23-24) could, in alternative embodiments, be provided with a central portion recess similar to those shown in FIGS. 12-18 and 25-27.

While screws have been illustrated in the figures as suitable fasteners for making the connections described above, any suitable fastener may be used to connect two separate items: e.g., clamps, clasps, collars, pins (tapered, spring, groove, cotter, spiral, dowel), cleats, ¼-turn fasteners, set screws, keys, clips, retainer rings, or adhesives.

The connections between separate pieces or items (e.g., front pieces and rear pieces; weights and rear pieces) that are shown in the figures are all removable connections. However, connections that are not removable could be made in alternative embodiments.

The claims are not to be interpreted as including means-plus- or step-plus-function limitations, unless such a limitation is explicitly recited in a given claim using the phrase(s) "means for" or "step for," respectively.

I claim:

1. A golf putter head comprising:

a front piece having a strike face and a rearmost portion; and a rear piece separate from and connected to the front piece, the rear piece including two or more arrowhead shapes that are substantially aligned behind one another, so as to be substantially perpendicular to, the strike face and that point toward the strike face, the rear piece also having a rearmost portion that is farther from the strike face than is the rearmost portion of the front piece;

where the front piece includes (a) a first recess in which a forward portion of the rear piece is at least partially positioned, and (b) a second recess that is closer to the strike face than the first recess, the second recess being substantially empty.

2. A golf putter head comprising:

a front piece having a strike face and a rearmost portion; and a rear piece separate from and connected to the front piece, the rear piece including two or more arrowhead shapes that are substantially aligned behind one another, so as to be substantially perpendicular to, the strike face and that point toward the strike face, the rear piece also having a rearmost portion that is farther from the strike face than is the rearmost portion of the front piece;

where the front piece includes a top surface and a bore extending into the front piece from the top surface at an angle of zero to 10 degrees to the strike face, and the two or more arrowhead shapes are behind the rearmost portion of the front piece.

3. A golf putter head comprising:

a front piece having a strike face and a rearmost portion; and a rear piece separate from and connected to the front piece, the rear piece including two or more arrowhead shapes that are substantially aligned behind one another, so as to be substantially perpendicular to, the strike face and that point toward the strike face, the rear piece also having a rearmost portion that is farther from the strike face than is the rearmost portion of the front piece;

where the front piece includes a top surface and a bore extending into the front piece from the top surface at an angle of zero to 10 degrees to the strike face, and where a rear piece bore extends into the rear piece, the rear piece bore being at least partially aligned with the bore in the front piece and having a smaller diameter than the bore in the front piece.

4. The golf putter head of claim 1 in which the strike face has a texture achieved by blasting the strike face with material that is number 6 grit in size or smaller.

5. A golf putter head comprising:

a front piece having a strike face and a rearmost portion; and a rear piece separate from and connected to the front piece, the rear piece including two or more arrowhead shapes that are substantially aligned behind one another, so as to be substantially perpendicular to, the strike face and that point toward the strike face, the rear piece also having a rearmost portion that is farther from the strike face than is the rearmost portion of the front piece;

where the rear piece has a mass, and (a) the front piece has a top and a bottom, (b) a plane intersects the strike face substantially mid-way between the top and the bottom and extends into and through a portion of the rear piece that is farther from the strike face than is the rearmost portion of the front piece, and (c) a majority of the mass of the rear piece is positioned above the plane.

6. A golf putter head comprising:

a front piece having a strike face and a rearmost portion; and a rear piece separate from and connected to the front piece, the rear piece including two or more arrowhead shapes that are substantially aligned behind one another, so as to be substantially perpendicular to, the strike face and that point toward the strike face, the rear piece also having a rearmost portion that is farther from the strike face than is the rearmost portion of the front piece;

where (a) the rear piece has a rear piece bottom surface, (b) one or more weight recesses extend into the rear piece from the rear piece bottom surface, and (c) a weight is at least partially positioned in one of the one or more weight recesses and removably connected to the rear piece with one or more fasteners.

7. A golf putter head comprising:

a front piece having a strike face and a rearmost portion; and a rear piece separate from and connected to the front piece, the rear piece including two or more arrowhead shapes that are substantially aligned behind one another, so as to be substantially perpendicular to, the strike face and that point toward the strike face, the rear piece also having a rearmost portion that is farther from the strike face than is the rearmost portion of the front piece;

where (a) the rear piece has a rear piece top surface, (b) one or more weight recesses extend into the rear piece from the rear piece top surface, and (c) a weight is at least partially positioned in one of the one or more weight recesses and removably connected to the rear piece with one or more fasteners.

8. A golf putter head comprising:

a front piece having a strike face and a rearmost portion; and a rear piece separate from and connected to the front piece, the rear piece including two or more arrowhead shapes that are substantially aligned behind one another, so as to be substantially perpendicular to, the strike face and that point toward the strike face, the rear piece also having a rearmost portion that is farther from the strike face than is the rearmost portion of the front piece;

where the two or more arrowhead shapes comprise arrowhead-shaped openings in the rear piece, and the two or more arrowhead shapes are behind the rearmost portion of the front piece.

9. A golf putter head comprising:

a front piece having a strike face and a rearmost portion; and a rear piece separate from and connected to the front piece, the rear piece including two or more arrowhead shapes that are substantially aligned behind one another, so as to be substantially perpendicular to, the strike face and that point toward the strike face, the rear piece also having a rearmost portion that is farther from the strike face than is the rearmost portion of the front piece;

where each arrowhead shape has an arrowhead angle; and the arrowhead angles of at least two arrowhead shapes decrease in size from a back end of the rear piece toward the strike face.

10. A golf putter head comprising:

a front piece having a strike face and a rearmost portion;

a rear piece separate from and connected to the front piece, the rear piece including two or more arrowhead shapes that are substantially aligned behind one another, so as to be substantially perpendicular to, the strike face and that point toward the strike face, the rear piece also having a rearmost portion that is farther from the strike face than is the rearmost portion of the front piece; and one or more weights that are removably connected to the rear piece.

11. A golf putter head comprising:

a front piece having a strike face, a top surface, a bottom surface, and a rearmost portion;

a rear piece separate from and connected to the front piece, the rear piece having a mass and a rearmost portion that is farther from the strike face than is the rearmost portion of the front piece; and a weight removably connected to the rear piece;

where a plane intersects the strike face substantially mid-way between the top surface and the bottom surface and extends into and through the rear piece, and a majority of the mass of the rear piece is positioned above the plane; and where the front piece includes (a) a first recess in which a forward portion of the rear piece is at least partially positioned, and (b) a second recess that is closer to the strike face than the first recess, the second recess being substantially empty.

12. A golf putter head comprising:

a front piece having a strike face, a top surface, a bottom surface, and a rearmost portion, the front piece including a bore extending into the front piece from the top surface at an angle of zero to 10 degrees to the strike face;

a rear piece separate from and connected to the front piece, the rear piece having a mass and a rearmost portion that is farther from the strike face than is the rearmost portion of the front piece; and a weight removably connected to the rear piece;

where a plane intersects the strike face substantially mid-way between the top surface and the bottom surface and extends into and through the rear piece, and a majority of the mass of the rear piece is positioned above the plane.

13. A golf putter head comprising:

a front piece having a strike face, a top surface, a bottom surface, and a rearmost portion;

a rear piece separate from and connected to the front piece, the rear piece having a mass and a rearmost portion that is farther from the strike face than is the rearmost portion of the front piece; and a weight removably connected to the rear piece;

where a plane intersects the strike face substantially mid-way between the top surface and the bottom surface and extends into and through the rear piece, and a majority of the mass of the rear piece is positioned above the plane; and where (a) the rear piece has a rear piece bottom surface, (b) one or more weight recesses extend into the rear piece from the rear piece bottom surface, and (c) the weight is at least partially positioned in one of the one or more weight recesses and removably connected to the rear piece with one or more fasteners.

14. The golf putter head of claim 13 in which the rear piece includes two or more weight recesses that extend into the rear piece from the rear piece bottom surface, a first weight is at least partially positioned in one of the weight recesses and removably connected to the rear piece with one or more fasteners, and a second weight is at least partially positioned in another of the weight recesses and removably connected to the rear piece with one or more fasteners.

15. A golf putter head comprising:

a front piece having a strike face, a top surface, a bottom surface, and a rearmost portion;

a rear piece separate from and connected to the front piece, the rear piece having a mass and a rearmost portion that is farther from the strike face than is the rearmost portion of the front piece; and a weight removably connected to the rear piece;

where a plane intersects the strike face substantially midway between the top surface and the bottom surface and extends into and through the rear piece, and a majority of the mass of the rear piece is positioned above the plane; and where (a) the rear piece has a rear piece top surface, (b) one or more weight recesses extend into the rear piece from the rear piece top surface, and (c) a weight is at least partially positioned in one of the one or more weight recesses and removably connected to the rear piece with one or more fasteners.

16. The golf putter head of claim 15 in which the rear piece includes two or more weight recesses that extend into the rear piece from the rear piece top surface, a first weight is at least partially positioned in one of the weight recesses and removably connected to the rear piece with one or more fasteners, and a second weight is at least partially positioned in another of the weight recesses and removably connected to the rear piece with one or more fasteners.

17. A golf putter head comprising:

a front piece having a strike face, a top surface, a bottom surface, and a rearmost portion;

a rear piece separate from and connected to the front piece, the rear piece having a mass and a rearmost portion that is farther from the strike face than is the rearmost portion of the front piece; and a weight removably connected to the rear piece;

where a plane intersects the strike face substantially midway between the top surface and the bottom surface and extends into and through the rear piece, and a majority of the mass of the rear piece is positioned above the plane; and where the rear piece includes at least two arrowhead-shaped openings that are substantially aligned behind one another, so as to be substantially perpendicular to, the strike face; each arrowhead-shaped opening has an arrowhead angle; and the arrowhead angles of at least two arrowhead-shaped openings decrease in size from a back end of the rear piece toward the strike face.

18. A golf putter head comprising:

a front piece having a strike face, a front piece top surface, a front piece bottom surface, a front piece rear surface, a bore extending into the front piece from the front piece top surface, a first recess extending into the front piece from the front piece rear surface, and a second recess that is closer to the strike face than the first recess, the second recess being substantially empty;

a rear piece separate from and removably connected to the front piece, the rear piece having a forward portion that is positioned at least partially within the first recess, and a mass; and two or more weights removably connected to the rear piece;

where a plane intersects the strike face substantially midway between the front piece top surface and the front piece bottom surface and extends into and through the rear piece, and a majority of the mass of the rear piece is positioned above the plane.

* * * * *